US005632923A

United States Patent [19]

Hayakawa

[11] Patent Number: 5,632,923

[45] Date of Patent: May 27, 1997

[54] CONCRETE MOLDING FORM MEMBER

[76] Inventor: Yoshiyuki Hayakawa, 2-5, Hiraoka 10-jo 1-chome, Toyohira-ku, Sapporo-shi, Hokkaido, Japan

[21] Appl. No.: 420,167

[22] Filed: Apr. 11, 1995

[30] Foreign Application Priority Data

Apr. 28, 1994 [JP] Japan ..... 6-113962
Oct. 6, 1994 [JP] Japan ..... 6-242874

[51] Int. Cl.[6] ..... E04G 11/00

[52] U.S. Cl. ..... 249/47; 249/134; 249/189; 249/192

[58] Field of Search ..... 249/189, 192, 249/195, 196, 194, 44, 47, 134

[56] References Cited

U.S. PATENT DOCUMENTS

| | | | |
|---|---|---|---|
| 3,246,871 | 4/1966 | Bowden | 249/192 |
| 3,291,436 | 12/1966 | Berghammer | 249/189 |
| 3,399,859 | 9/1968 | Bowden et al. | 249/189 |
| 4,076,206 | 2/1978 | Marseillan | 249/189 |
| 4,915,345 | 4/1990 | Lehmann | 249/196 |
| 5,137,251 | 8/1992 | Jennings | 249/189 |
| 5,205,942 | 4/1993 | Fitzgerald | 249/192 |
| 5,431,366 | 7/1995 | Matsumoto et al. | 249/189 |

FOREIGN PATENT DOCUMENTS

| | | | |
|---|---|---|---|
| 123264 | 10/1984 | European Pat. Off. . | |
| 448120 | 9/1991 | European Pat. Off. . | |
| 987069 | 8/1951 | France . | |
| 1011770 | 7/1952 | France . | |
| 727391 | 10/1942 | Germany | 249/196 |
| 65-54149 | 4/1987 | Japan . | |
| 2-8549 | 1/1990 | Japan . | |
| 5-59811 | 3/1993 | Japan . | |
| 2216584 | 10/1989 | United Kingdom . | |

*Primary Examiner*—Khanh P. Nguyen
*Attorney, Agent, or Firm*—Lowe, Price, LeBlanc & Becker

[57] ABSTRACT

An integrally molded concrete molding form member is made of a fiber-reinforced plastic and formed of a long flat front plate portion, a pair of horizontal side plate portions perpendicularly extending from cross-sectional ends of the front plate portion toward its back surface, and a horizontal pair of rear plate portions perpendicularly inwardly extending from forward ends of the side plate portions opposed to the back surface of the front plate portion. Each of the front plate portion, the side plate portions and the rear plate portions is provided with a plurality of mounting holes in the same longitudinal positions at prescribed intervals to facilitate connecting front, side, back, upper and lower surfaces.

6 Claims, 45 Drawing Sheets

(a)

CONCRETE MOLDING FORM MEMBER

BACKGROUND OF THE INVENTION

1. Field of the Invention

The present invention relates to a concrete molding form member for assembling a concrete formwork which is employed for placing concrete or molding a concrete secondary product in construction and civil engineering works, and a form member space holder and a form member connector which are employed for assembling the form member.

2. Description of the Background Art

In general, a wood form member comprising a plywood board and bridges which are nailed thereto and a metal form member comprising an iron plate or an aluminum plate and metal ribs which are fixed thereto are known as such concrete molding form members. As shown in FIG. 54A, a typical example of the conventional wood form member 70 comprises a flat plate 71 of plywood which is fixed to a plurality of reinforcing bridges 73 with nails 72, for example. In order to assemble a concrete formwork, endmost reinforcing bridges 72 of adjacent form members 70 are fastened to each other with nails 73, for coupling/fixing the form members 70 with/to each other. FIG. 54B shows an exemplary concrete formwork which is assembled in the aforementioned manner to have a cross concrete molding part 74. The flat plates 71 can be formed by plastic plates, for example, in place of the plywood boards.

Description is now made on an example of a conventional form member space holder for fixing a pair of the aforementioned form members 70 with a prescribed space through concrete placing surfaces for assembling a concrete formwork, with reference to FIGS. 55 and 56A to 56C. Referring to FIG. 55, the conventional form member space holder is mainly formed by a separator 121, attachments 122 and clamp members 123. As shown in FIG. 56A, the separator 121 comprises a bar and a pair of male screws 121*a* which are provided on both ends thereof. Each male screw 121*a* is fitted with a female screw 122*c* which is provided on a first end of each attachment 122 as shown in FIG. 56B. A male screw 122*d* which is provided on a second end of the attachment 122 substantially coaxially with the female screw 122*c* passes through a separator mounting hole 76 which is provided in each form member 70, so that an end of a substantially truncated-conical resin presser part 122*a* which is engaged with the outer periphery of an attachment body part 122*b* is in contact with the concrete placing surface of the form member 70. A female screw 123*a* which is provided on a first end of each clamp member 123 is fitted with the male screw 122*d* of the attachment 122, thereby clamping/fixing the attachment 122 to each form member 70.

A male screw 123*b* is provided on a second end of each clamp member 123 as shown in FIG. 56C, so that a support member 124 and a nut 125 which are mounted on this male screw 123*b* fix thin cylindrical form member support members 126 of a metal for bridging a plurality of transversely arranged form members 70, as shown in FIG. 55.

FIG. 57A shows a typical example of a conventional metal form member 80 comprising a metal flat plate 81, and side plates 82 and reinforcing plates 83 which are bonded/fixed to the same. FIG. 57B shows a concrete formwork having a cross concrete molding part 84, which is assembled by a plurality of such metal form members 80. In this formwork, metal reinforcements 85 are employed in intersections of the cross concrete molding part 84, in addition to the form members 80.

Japanese Utility Model Laying-Open No. 62-54149 (1987) discloses a conventional synthetic resin form member which is also well known in the art. In the synthetic resin form member described in this gazette, reinforcing projections which are made of plastic are integrally provided on four points of a back surface portion of a plate member having a square front surface. The projections are provided with holes for receiving links, while the plate member is also provided with holes for receiving separators in prescribed portions thereof.

Japanese Patent Laying-Open No. 2-8459 (1990) discloses a concrete placing form member consisting of a press-molded sheet containing 50 to 10 percent by weight of glass fiber mat in 50 to 90 percent by weight of thermosetting resin. On the other hand, Japanese Patent Laying-Open No. 5-59811 (1993) discloses a concrete placing form member comprising a face plate and reinforcing ribs which are provided at least along the longitudinal direction of the face plate. In this form member, the face plate is formed by a fiber reinforced plastic member, while a fiber reinforced plastic material forming the ribs (longitudinal ribs) along the longitudinal direction has a bending elastic modulus of at least 10 GPa and longitudinal flexural rigidity of the form member is set to be at least $2.5\times10^7$ kgf·mm$^2$ per unit width (1 cm) of the form member.

Among the aforementioned conventional examples, the wood form member can be recycled merely 3 to 4 times since the plywood board is separated from its end portion upon employment of several times due to absorption of alkaline moisture, requires skillfulness for assembling/execution, is unsuitable for global environmental protection due to consumption of lauan raw material and industrial waste resulting from the spent form member, and cannot be applied to high-quality concrete having a low slump value and high strength since employment of a vibrator is limited due to low strength, although the same is lightweight and has a degree of freedom in execution.

Due to high water absorptivity of the plywood board, further, the concrete as placed loses an ideal water-cement ratio in a surface portion which is in contact with the plywood board, resulting in a rough state of the finished concrete outer surface. Since an erroneous decision may be made on defective hardening of the concrete in this case, prescribed painting is applied to the surface of the plywood board for reducing its water absorptivity. However, such a painted plywood board is high-priced and hence the cost is disadvantageously increased.

On the other hand, the metal form member can be hardly applied to general construction works since the executable range is limited due to a small degree of freedom in working, although the same has high strength. Further, the metal form member must be miniaturized due to its heavy weight, leading to inferior executability. Further, insufficient management leads to unusability due to rusting and/or deformation, and it is extremely difficult to repair such a rusted/deformed form member.

While the synthetic resin form member can provide an excellent concrete finished surface, further, the aforementioned form member described in Japanese Utility Model Laying-Open No. 62-54149, which comprises a plate member and solid prism-shaped projections similarly to the wood form member except that the same are made of synthetic resin, has a heavy weight and can be manufactured only by press molding due to limitation in its shape, with requirement for a high manufacturing cost.

Further, existent synthetic form members including those described in Japanese Patent Laying-Open Nos. 2-8459 and 5-59811 are not beyond the ranges of the shapes and functions of the wood and metal form members. Namely, the surfaces, the both side ribs and the back surfaces of such form members have only functions for serving as concrete molding surfaces, form member connecting members and reinforcement forming surfaces respectively, and hence only a single function is decided every surface in these existing form members. Thus, a synthetic resin form member can be used only in the same method as those for the remaining existent form members.

In addition, the conventional synthetic resin form member, which is manufactured by press molding, is insufficient in strength and high-priced, and hence the same is hardly put into practice under the present circumstances. Further, the conventional synthetic resin form member is inferior in workability for connection and demolition, since such members are connected with each other through nails or bolts and nuts.

In the conventional form member space holder described with reference to FIGS. 55 to 56C, on the other hand, the resin presser part 122*a* and the body part 122*b* of each attachment 122 are positioned on the concrete placing surface of each form member 70, and hence it is necessary to mount the separator 121 and the attachments 122 before fixing the positions of a pair of form members 70. Once the positions of the form members 70 are fixed, the separator 122 and the attachments 122 can be neither mounted nor demounted, leading to inferior workability.

SUMMARY OF THE INVENTION

An object of the present invention is to provide a concrete molding form member comprising the respective advantages of the conventional wood, metal and synthetic resin form members and having both functions of concrete molding surfaces and connecting surfaces not only in its surface but in its side surfaces, its back surface and its upper and lower surfaces to be used in a method absolutely different from that for the conventional synthetic resin form member, and a form member connector which is employed for connecting such form members.

Another object of the present invention is to provide a form member connector which can connect form members or a form member with each other or with a form member reinforcement in an extremely simple operation.

Still another object of the present invention is to provide a form member space holder which is improved in workability for setting a space between a pair of form members, being arranged to be opposite to each other through a concrete placing part in assembling of a concrete formwork, and fixing the same to each other.

In order to solve the aforementioned problems, the inventive concrete molding form member comprises a strip front plate portion which is flat at least on its surface, a horizontal pair of strip side plate portions extending from both ends of the front plate portion toward its back surface perpendicularly to the front plate portion, and a horizontal pair of strip rear plate portions inwardly extending from rear ends of the respective side plate portions perpendicularly to the side plate portions to be opposite to the back surface of the front plate portion.

Each of the front plate portion, the side plate portions and the rear plate portions is provided with a plurality of mounting holes on corresponding positions in relation to the longitudinal direction at prescribed intervals along the longitudinal direction, while distances between centers of the mounting holes which are provided in the side plate portions and the front plate portion are set to be substantially equal to those between centers of the mounting holes which are provided in the rear plate portions and the side plate portions which are adjacent to the rear plate portions.

According to this structure, it is possible to connect/fix a pair of the inventive concrete molding form members with/to each other by bringing the side plate portions of the form members or the side plate portions of the first form member and the rear plate portions of the second form member into contact with each other for overlapping the centers of the corresponding mounting holes provided in the form members with each other, and attaching form member connectors through the mounting holes. Consequently, it is possible to provide functions for serving as both of concrete molding surfaces and form member connecting surfaces not only on the surface of the front plate portion of each form member but on the back surface thereof and surfaces of the side plate portions. Thus, the degree of freedom in execution is so increased that it is possible to readily assemble concrete formworks of various shapes in combination with form member auxiliary materials having U-shaped or L-shaped sections, dissimilarly to the conventional form members.

According to a preferred embodiment of the inventive concrete molding form member, the front plate portion, the pair of side plate portions and the pair of rear plate portions define a form member body, and the concrete molding form member further comprises an end plate body having a horizontal end plate portion which is arranged at least on one of upper and lower ends of the form member body for shielding an upper or lower end of a space, having a rectangular horizontal section, enclosed with the front plate portion, the pair of side plate portions and the pair of rear plate portions, and a vertical end plate portion extending from a rear end of the horizontal end plate portion perpendicularly to the horizontal end plate portion to be in contact with inner surfaces of the pair of rear plate portions.

The horizontal and vertical end plate portions are provided with mounting holes in horizontal centers thereof respectively, and distances between centers of the mounting holes of the horizontal and vertical end plate portions and the surface of the front plate portion and a surface of the horizontal end plate portion are set to be substantially equal to those between the centers of the mounting holes which are provided in the side plate portions and the front plate portion.

According to this structure, it is possible to bring the horizontal end plate portion of a first form member into contact with the vertical end plate portion of a second form member for overlapping centers of the respective mounting holes with each other thereby fixing the form members to each other by form member connecting portions through the mounting holes, since the end plate body having the horizontal and vertical end plate portions is engaged with at least either the upper or lower end of the form member body while the distances between the centers of the mounting holes provided in the horizontal and vertical end plate portions and the surface of the front plate portion and the surface of the horizontal end plate portion are set to be substantially equal to each other. Thus, it is possible to connect the end portions of two form members so that the form members are perpendicular to each other. Consequently, it is possible to assemble concrete molding formworks of various shapes, to ensure application to wide usages.

Due to the end plate body which is engaged with either end of the form member body, further, it is possible to improve rigidity on this end portion, thereby implementing higher strength against a pressure in concrete placing.

According to another preferred embodiment of the inventive concrete molding form member, the front plate portion, the pair of side plate portions and the pair of rear plate portions consist of an integrally formed fiber reinforced plastic member. Further, the form member body and the end plate body of this concrete molding form member may be formed by integrally formed fiber reinforced plastic members respectively.

According to this structure, it is possible to implement a relatively lightweight form member having high strength, due to the form member body or the end plate body which is formed by an integrally formed fiber reinforced plastic member. Further, the form member of such a material is extremely advantageous in view of the production cost, since the same can be formed by continuous draw molding.

Further, it is possible to readily connect two or more concrete molding form members along the longitudinal direction by providing pairs of through holes in the vicinity of horizontal side portions of the horizontal end plate portions of the end plate bodies forming the concrete molding form members, arranging the concrete form members in series with each other so that the through holes of the horizontal end plate portions are opposite to each other, and inserting pipe-shaped long bars engageable with the opposite through holes therein.

According to still another preferred embodiment of the inventive concrete molding form member, the pair of rear plate portions of the form member body are provided on inner side end portions thereof with reinforcing thick portions extending from the inner side end portions toward the front plate portion perpendicularly to the pair of rear plate portions, and respective ones of the pair of through holes provided in the horizontal end plate portion of the end plate body are arranged in positions vertically aligned with a horizontal pair of spaces having square horizontal sections which are enclosed with the front plate portion, the pair of side plate portions, the pair of rear plate portions and the pair of reinforcing thick portions respectively.

According to this structure, it is possible to prevent misalignment between the pipe-shaped long bar and the concrete molding form member by storing the pipe-shaped long bar which is inserted in the through holes provided in the horizontal end plate portion in the spaces having square horizontal sections enclosed with the front plate portion, the pair of side plate portions, the pair of rear plate portions and the pair of reinforcing thick portions respectively, due to the reinforcing thick portions which are provided on the inner side end portions of the pair of rear plate portions. The pipe-shaped long bar which is strongly mounted on the concrete molding form member can serve not only as a connector for connecting a plurality of concrete molding form members along the longitudinal direction but a reinforcing member.

A form member connector according to the present invention comprises a transversely extending insertional shaft portion having one free end, a first holding portion perpendicularly bently extending from a forward end of the insertional shaft portion, a grip portion perpendicularly bently extending from a forward end of the first holding portion along the same direction as the insertional shaft portion, and a second holding portion perpendicularly bently extending from another end of the grip portion substantially in parallel with the first holding portion with a free forward end, and this form member connector is entirely made of an elastic material.

According to this structure, it is possible to connect a pair of concrete molding form members with each other by inserting the insertional shaft portion in each of the mounting holes of the form members which are brought into contact with each other for overlapping the mounting holes with each other, unidirectionally rotating the grip portion about the insertional shaft portion and holding adjacent rear plate portions of the pair of form members by the first and second side form member holding portions. Thus, it is possible to assembly a concrete formwork in a simple operation, with improvement in workability.

According to a preferred embodiment, the inventive form member connector comprises an insertional shaft portion which is provided with a female screw on a first end thereof, a movable stop portion which is fitted with the female screw portion to be reciprocative along the insertional shaft portion, and a clamp lever which is pivotally supported on a second end of the insertional shaft portion to be rotatable about an axis which is perpendicular to the insertional shaft portion.

According to this structure, it is possible to connect/fix a pair of concrete molding form members or a concrete molding form member and a form member auxiliary member with/to each other by inserting the insertional shaft portion in each of mounting holes of the pair of concrete molding form members or the concrete form member and the form member auxiliary member and rotating the clamp lever.

A form member space holder according to the present invention comprises a separator consisting of a bar having a prescribed length which is provided with male screws on both end portions thereof, a pair of attachments having first ends which are fixed to both end portions of the separator respectively, and clamp members which are fixed to second ends of the pair of attachments respectively for fixing the separator and the attachments to form members by clamping. Each of the pair of attachments is provided with a first female screw opening on its first end to be fitted with the male screw provided on each end of the separator and a second female screw, which is substantially coaxial with the first female screw, opening on its second end. Further, each of the pair of attachments has such an outer diameter difference that the outer diameter of the first end is smaller than that of the second end. In addition, the pair of clamp members have first male screw portions which are fitted with the second female screws of the pair of attachments on first ends thereof and second female screw portions which are substantially coaxial with the first male screw portions on second ends thereof.

The first ends of the pair of attachments are engaged in separator mounting holes of a pair of opposite form members while second end surfaces of the pair of attachments are pressed toward the first ends by brackets which are engaged in the pair of form members respectively. According to this structure, it is possible to mount the form member space holder in a state of mutually fixing positions of the pair of form members. Namely, it is possible to mount and fix the form member space holder by fitting one attachment with the male screw on one end of the separator, inserting the separator from the separator mounting hole of one form member for engaging this attachment with the separator mounting hole of the form member and fitting the female screw of the other attachment which is engaged with the separator mounting hole of the other form member. Thus, it is possible to simplify mutual fixation of a pair of opposite form members with relatively simple parts, thereby remarkably contributing to improvement in workability for assembling a concrete formwork through the inventive form members without increasing the cost.

According to another aspect, the inventive form member space holder is adapted to position and fix concrete molding form members, which are assembled with each other for forming a concrete formwork, to be opposed to each other with a prescribed space, and comprises a separator consisting of a bar having a prescribed length which is provided with male screws on both end portions thereof, and a pair of clamp members for positioning the opposite form members respectively in a state mounted on the end portions of the separator. Each of the pair of clamp members has a clamp portion axially extending along the separator in a state mounted on the separator and provided with a female screw opening on a first end which is in contact with the form member to be fitted with the male screw of the separator, and a support portion, which is continuous with the clamp portion on a second end of the clamp portion, extending substantially perpendicularly to the direction of extension of the clamp portion for supporting a bar-shaped form member support member which is bridged on the exterior of the formwork as formed for bringing the same into contact with the form member with the clamp portion of the clamp member being in a state mounted on the separator.

According to this structure, it is possible to position the pair of opposite form members by fitting the male screws provided on both ends of the separator with the female screws of the pair of clamp members and bringing the end portions of the clamp members provided with the female screws into contact with the pair of form members respectively, and to simultaneously support the form member support member in a state being in contact with the form members by the clamp members. Further, the clamp members can be prepared by integrally forming a plastic material. Thus, it is possible to attain further remarkable effects of improving the workability and saving the cost.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
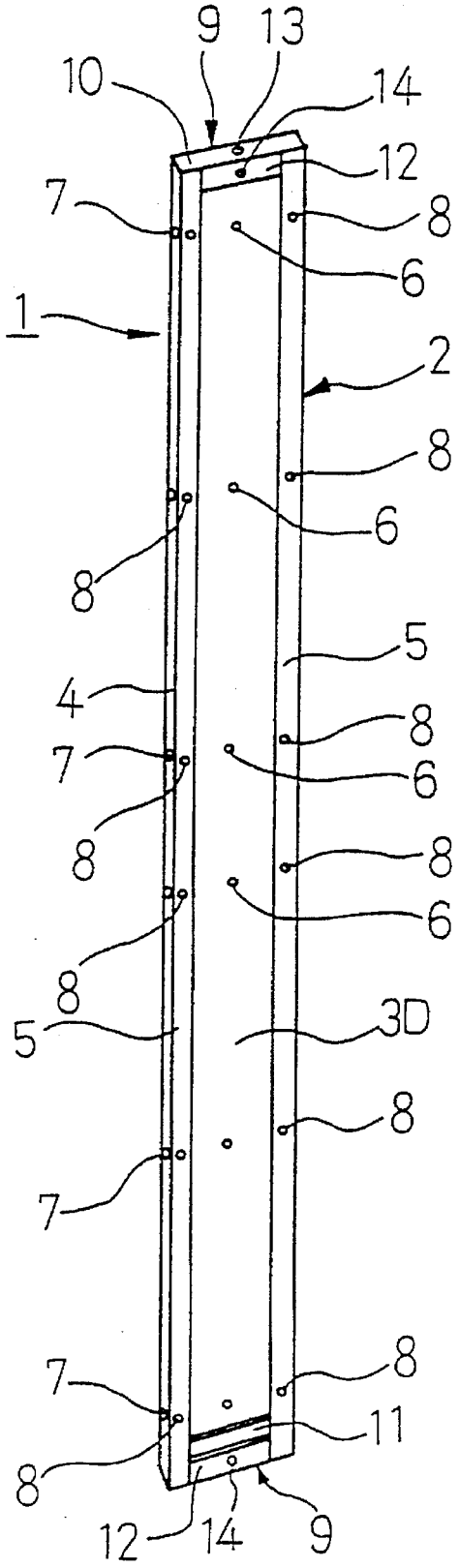
FIG. 1 is a perspective view showing the overall structure of a concrete molding form member according to an embodiment of the present invention as viewed from behind.

An embodiment of the present invention is now described with reference to the drawings. Referring to FIG. 1, a concrete molding form member 1 according to this embodiment comprises a front plate portion 3, a pair of strip side plate portions 4, and a pair of strip rear plate portions 5. FIG. 1 is a perspective view showing the concrete molding form member 1 from behind.

Figure 2:
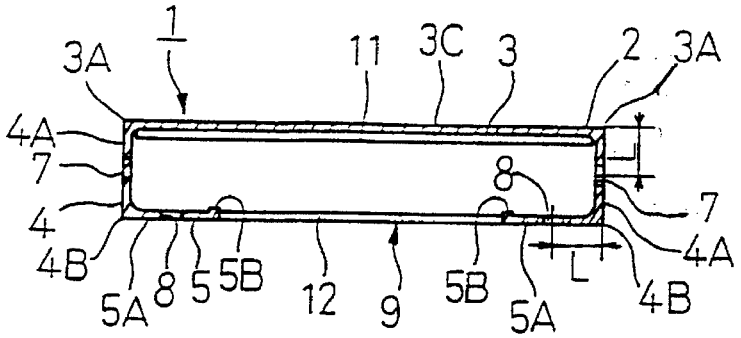
FIG. 2 is a cross-sectional view showing the concrete molding form member appearing in FIG. 1, taken along a position provided with mounting holes.
Figure 3:
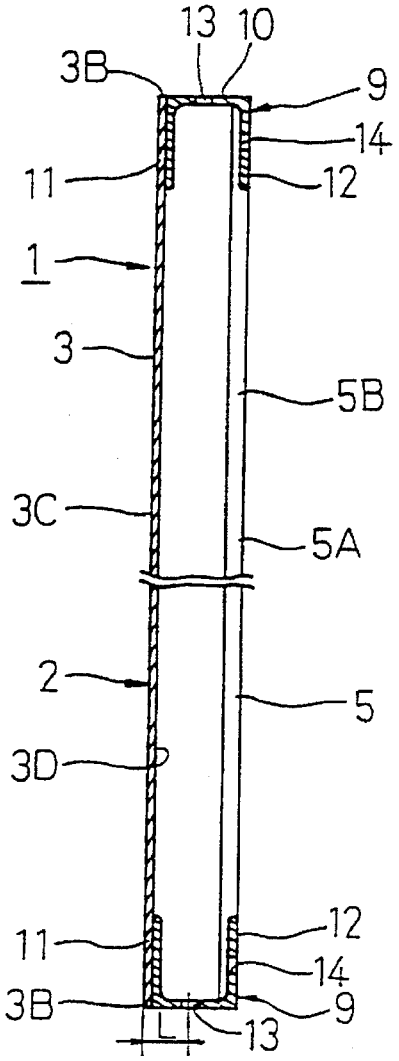
FIG. 3 is a central longitudinal sectional view of the concrete molding form member shown in FIG. 1.

Referring to FIGS. 2 and 3, the front plate portion 3 of the concrete molding form member 1 according to this embodiment is formed by a long flat plate having cross-sectional ends 3A, longitudinal ends 3B which are separated from each other by a length of about 10 times that between the cross-sectional ends 3A, a flat surface 3C and a flat back surface 3D. The pair of side plate portions 4 are in the form of long strip bodies perpendicularly extending from the cross-directional ends 3A of the front plate portion 3 toward the back surface 3D to be opposite to each other and having flatly formed surfaces 4A. Further, the pair of rear plate portions 5 are in the form of long strip bodies perpendicularly inwardly extending from cross-directional forward ends 4B of the side plate portions 4, to face the back surface 3D of the front plate portion 3. The rear plate portions have flatly formed surfaces 5A and inwardly projecting forward ends forming reinforcing thick portions 5B.

A form member body 2 according to this embodiment defined by the front plate portion 3, the pair of side plate portions 4 and the pair of rear plate portions 5 which are integrally formed with each other is integrally molded by a fiber reinforced plastic material through continuous draw molding, and the thicknesses of the front plate portion 3 and the side plate portions 4 are set at about 5 mm respectively, while those of the reinforcing thick portions 5B are set at about 10 mm. The reinforcing fiber is preferably prepared from glass fiber, while the same may alternatively be prepared from carbon fiber or Aramid fiber. On the other hand, the plastic component is preferably prepared from polyester-based thermosetting resin, while the same may alternatively be prepared from thermoplastic resin.

The front plate portion 3 of the form member body 2 according to this embodiment is provided on its cross-sectional center with a plurality of mounting holes 6 at prescribed intervals along the longitudinal direction. On the other hand, each of the pair of side plate portions 4 is also provided with a plurality of mounting holes 7 in correspondence to the positions of the mounting holes 6 provided in the front plate portion 3 respectively, and each of these mounting holes 7 is arranged on a position which is cross-directionally separated from the surface 3C of the front plate portion 3 by a prescribed distance L. Further, each of the pair of rear plate portions 5 are provided with a plurality of mounting holes 8 also in correspondence to the positions of the mounting holes 6 provided in the front plate portion 3, and each of these mounting holes 8 is also arranged on a position which is cross-directionally separated from the surface 3C of the front plate portion 3 by the same prescribed distance L.

Figure 4:
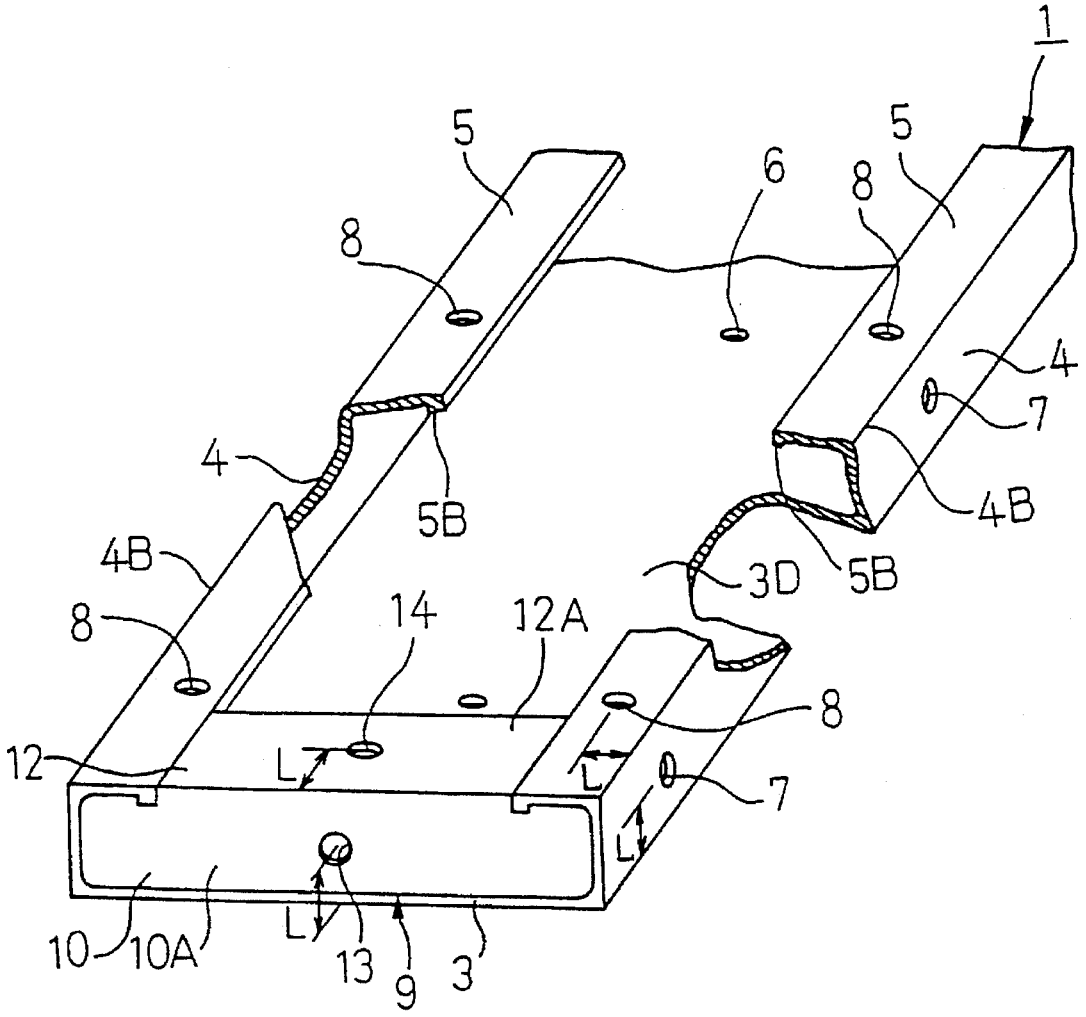
FIG. 4 is a partially enlarged perspective view showing a portion which is close to an end of the concrete molding form member appearing in FIG. 1 in a partially fragmented manner.

With reference to FIGS. 3 and 4, end plate bodies 9 which are engaged with longitudinal ends of the form member body 2 are now described. Each end plate body 9 is integrally formed by a fiber reinforced plastic member having a substantially U-shaped section which is provided with a flat horizontal end plate portion 10 shielding either longitudinal end of the form member body 2 and a pair of vertical end plate portions 11 and 12 perpendicularly extending from front and rear ends of the horizontal end plate portion 10 respectively.

The horizontal end plate portion 10 is formed to be engaged with a space having a rectangular plane shape which is enclosed with the front plate portion 3, the pair of side plate portions 4 and the pair of rear plate portions 5. In the pair of vertical end plate portions 11 and 12, the front end surface of the front vertical end plate portion 11 is in contact with and fixed to the back surface 3D of the front plate portion 3, while the rear vertical end plate portion 12 is formed to be engaged between the pair of rear plate portions 5 while facing the vertical end plate portion 11. All of surfaces 10A, 11A and 12A of the horizontal end plate portion 10 and the pair of vertical end plate portions 11 and 12 are flatly formed respectively.

A mounting hole 13 is provided in the longitudinal center of each horizontal end plate portion 10, and this mounting hole 13 is arranged in a position separated from the surface 3C of the front plate portion 3 along the cross direction of the horizontal end plate portion 10 at a distance which is substantially identical to the distance L between the center of each mounting hole 7 and the surface 3C of the front end portion 3. Further, a mounting hole 14 is formed in the longitudinal center of the rear vertical end plate portion 12, and the center of this mounting hole 14 is arranged in a position separated from the surface 10A of the horizontal end plate portion 10 along the cross direction of the vertical end plate portion 12 at a distance which is substantially identical to the distance L.

Figure 29:
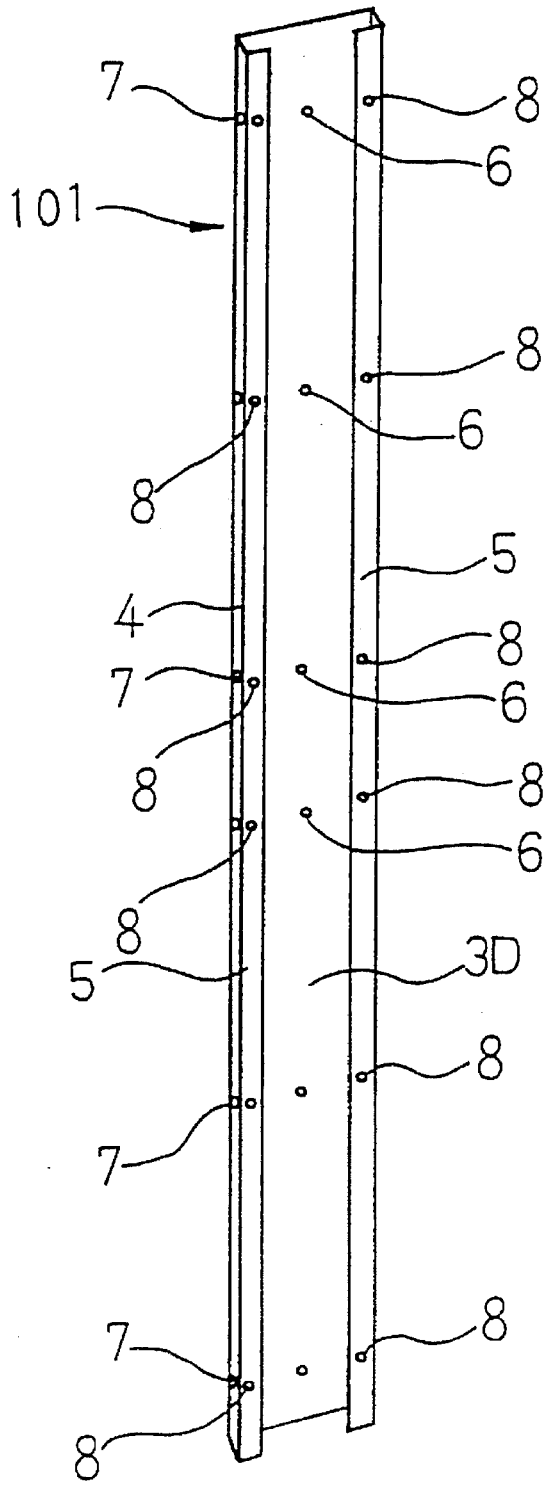
FIG. 29 is a perspective view showing a form member according to another embodiment of the present invention as viewed from behind.

Due to the end plate bodies 9 provided in the form member 1 according to this embodiment, it is possible to connect end portions of two form members as described later with reference to FIG. 18, as well as to improve rigidity in the vicinity of the end portions of the form members. If it is not necessary to connect/fix end portions of such form members with/to each other, or no high strength is required in the vicinity of the end portions of the form members, however, it is also possible to employ a form member 101 which is engaged with no end plate bodies 9 on its end portions, as shown in FIG. 29.

Figure 11:
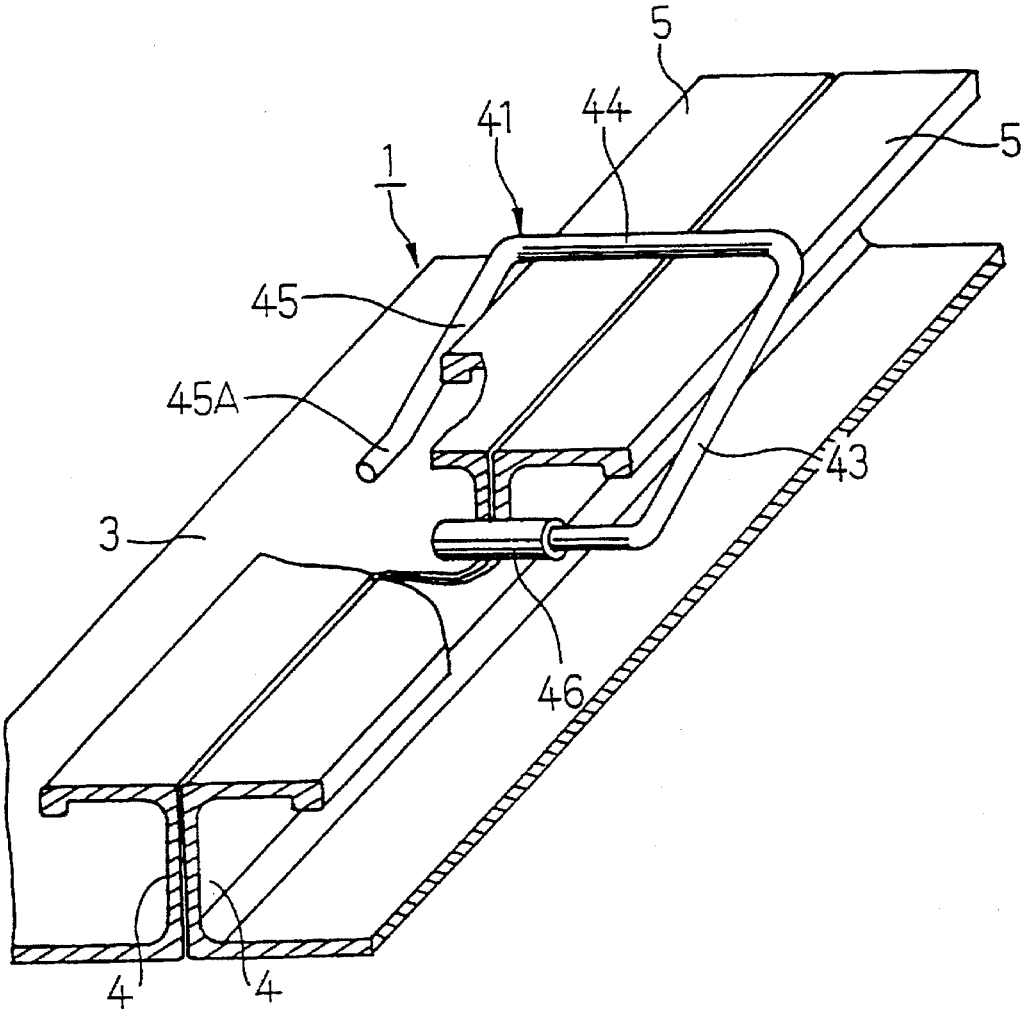
FIG. 11 is a partially fragmented enlarged perspective view for illustrating a state of employment of the form member connecting clip.

While the inwardly projecting reinforcing thick portions 5B are provided on the forward ends of the pair of rear plate portions 5 forming the form member body 2 in the concrete molding form member 1 according to this embodiment, these reinforcing thick portions 5B serve as ribs for increasing the strength of the rear plate portions 5 which are pressed/held by a clip on end portions thereof when two form members are connected with/fixed to each other by a specific form member connector such as the clip holding the rear plate portions 5, as described later with reference to FIG. 11. Therefore, when the form members are connected with/fixed to each other not by such a clip-type form member connector but in a manner described later with reference to FIGS. 12 to 14, for example, it is not necessary to provide the reinforcing thick portions 5B since no such strength is required for the rear plate portions 5 in this case.

Figure 30A:
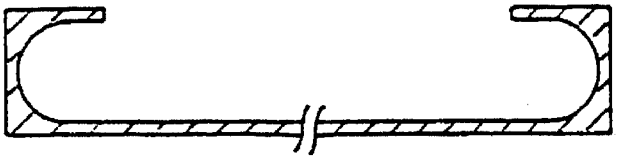
FIGS. 30A to 30C are partially fragmented sectional views showing three modifications of sectional shapes in the vicinity of vertical or transverse ends of the form member according to the present invention.
Figure 30B:
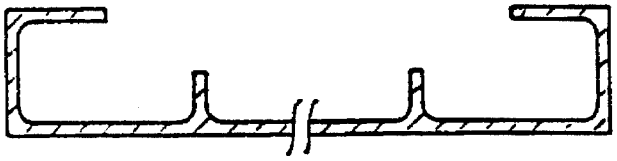
Figure 30C:
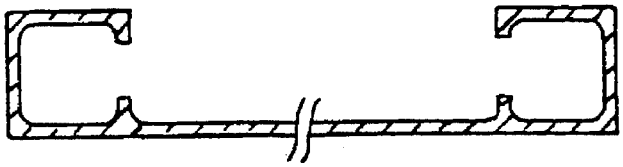

The longitudinal or cross section of the form member 1 is not restricted to the shape shown in the aforementioned embodiment, but various modifications are available in response to the strength as required. FIGS. 30A to 30C illustrate three types of sectional shapes in the vicinity of longitudinal or transverse end portions of form members. FIG. 30A shows a longitudinal or transverse U-shaped end portion of a form member whose inner side is substantially in the form of a cylindrical surface to have thick corner portions. Referring to FIG. 30B, on the other hand, reinforcing ribs are provided in the vicinity of longitudinal or transverse end portions of a form member. Referring to FIG. 30C, further, longitudinal or transverse end portions of a form member are in the form of cylinders having rectangular sections. Due to such modifications of the sectional shape, rigidity is reinforced particularly in the vicinity of the end portions of the form members, thereby providing form members capable of forming concrete formworks having high pressure resistance.

Connectors which are employed as auxiliary materials for assembling a concrete formwork through the concrete molding form member 1 according to this embodiment are now described with reference to FIGS. 5 to 8.

Figure 5:
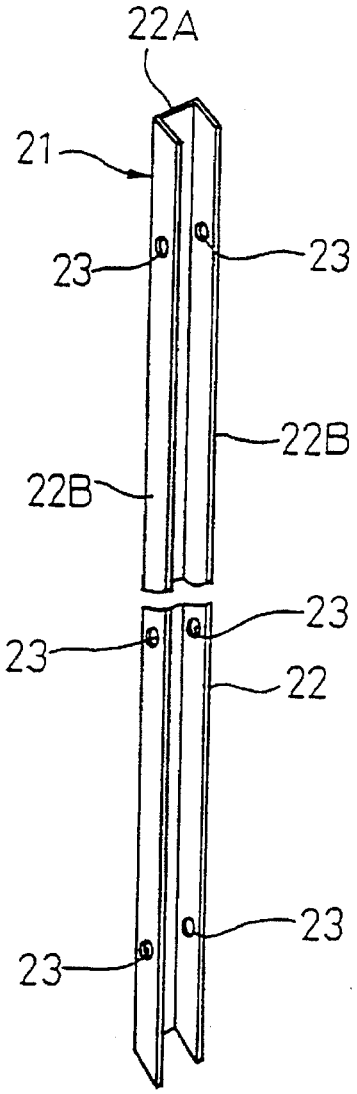
FIG. 5 is a perspective view showing the appearance of a connector having a U-shaped section.
Figure 6:
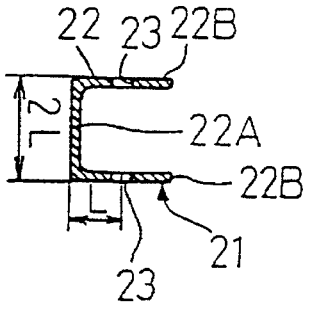
FIG. 6 is a cross-sectional view of the connector shown in FIG. 5 taken along a position provided with mounting holes.

FIGS. 5 and 6 show a connector 21 having a U-shaped section, as a first exemplary connector. This connector 21 is provided with a long base plate portion 22 having a cross-directional size 2L which is substantially twice the distance L between each of the mounting holes 7 and 8 and the surface 3C, and a pair of connecting plate portions 23, having the same cross-directional size 2L as the base plate portion 22, perpendicularly extending from cross-directional edges of the base plate portion 22 to face each other, while the base plate portion 22 and the connecting portions 23 are integrally formed by a fiber reinforced plastic member. Further, surfaces 22A and 23A of the base plate portion 22 and the connecting plate portions 23 are flatly formed while a plurality of mounting holes 24 are provided in the cross-directional center of each connecting plate portion 23 in longitudinal positions corresponding to those of the mounting holes 6 and 7 provided in the form member body 2. The distance L between each mounting hole 24 and the surface 22A of the base plate portion 22 is identical to that between each mounting hole 7 or 8 of the form member 1 and the surface 3C.

Figure 7:
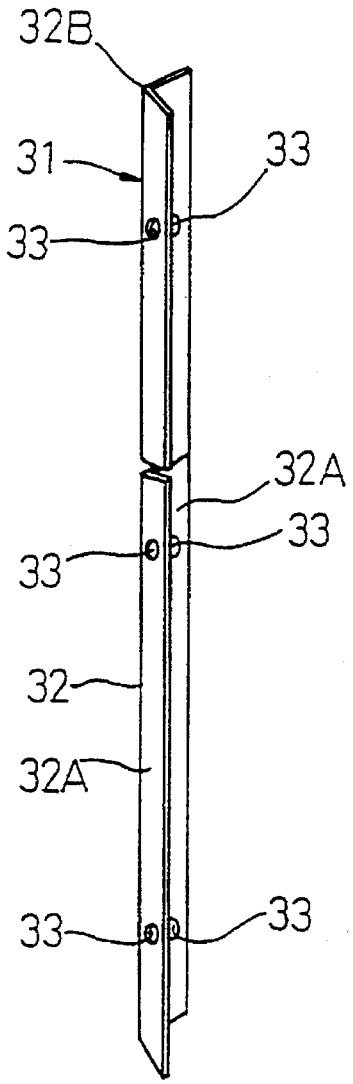
FIG. 7 is a perspective view showing the appearance of a connector having an L-shaped section.
Figure 8:
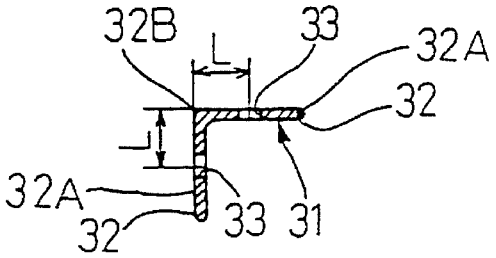
FIG. 8 is a cross-sectional view of the connector shown in FIG. 7 taken along a position provided with mounting holes.

FIGS. 7 and 8 show a connector 31 having an L-shaped section, as a second exemplary connector. This connector 31 is formed by a pair of connecting plate portions 32 which are integrally molded in an L shape by a fiber reinforced plastic material to have flatly formed surfaces 32. Each connecting plate portion 32 is provided in its cross-sectional center with a plurality of mounting holes 33 in longitudinal positions corresponding to the respective mounting holes 6, 7 and 8 of the form member body 2 at prescribed spaces, and the distance L between each mounting hole 33 and an outer angular corner 32B of the connecting plate portion 32 is set to be identical to that between each mounting hole 7 or 8 of the form member 1 and the surface 3C.

Figure 31A:
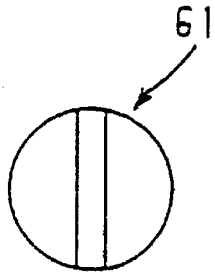
FIG. 31A is a front elevational view showing a plug 61 for closing a mounting hole 6 of a form member body 2 or the like, FIGS. 31B, 31C and 31D are a right side elevational view, a rear elevational view and a perspective view thereof respectively.
Figure 31B:
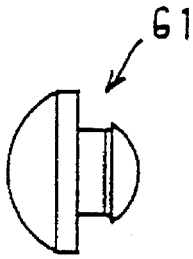
FIG. 31E is a partially fragmented sectional view showing the plug 61 which is engaged in the mounting hole 6 of the form member body 2.
Figure 31C:
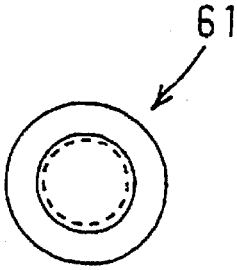
Figure 31D:
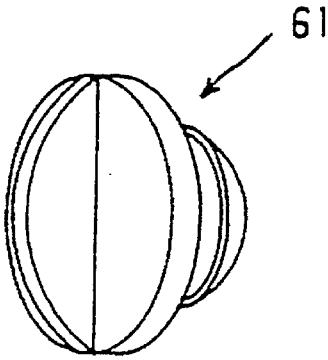
Figure 31E:
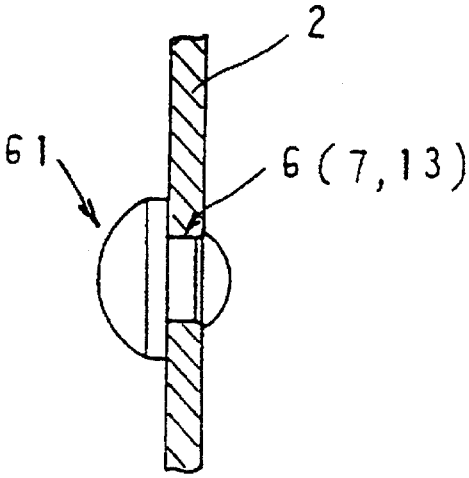

It is possible to form various concrete molding form panels by properly combining the form members 1 and the auxiliary materials 21 according to this embodiment, as described later. Depending on the manners of structuring the form panels, the mounting holes 6, 7 and 13 are located on concrete molding surfaces, and each of the mounting holes 6, 7 and 13 is closed as shown in FIG. 31E by a synthetic resin plug 61 shown in FIGS. 31A to 31D, for preventing leakage of the concrete as placed from the mounting holes 6, 7 and 13.

Figure 32A:
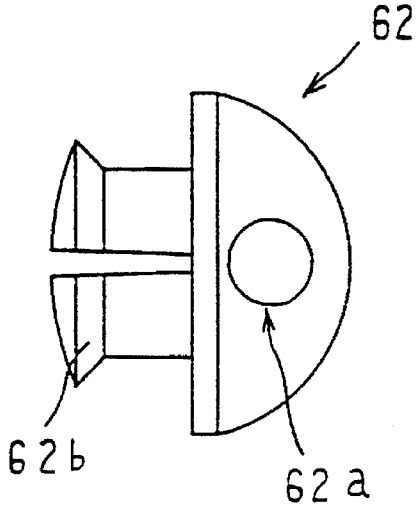
FIG. 32A is a front elevational view of a further improved plug 62 for closing a separator mounting hole provided in the form member according to the present invention or the like, FIGS. 32B and 32C are right and left side elevational views thereof respectively.
Figure 32B:
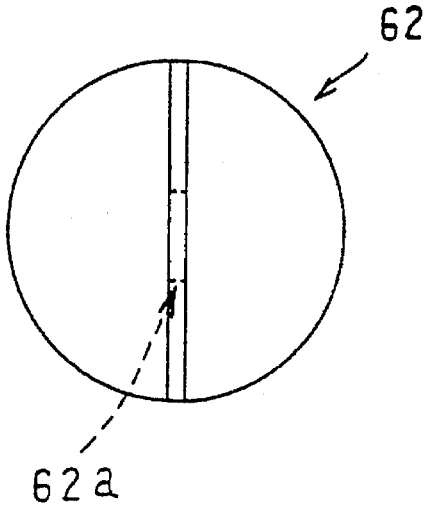
FIG. 32D is a partially fragmented sectional view showing the plug 62 which is mounted on a separator mounting hole 6 of a form member 2 while opening a mounting hole protective cup 63.
Figure 32C:
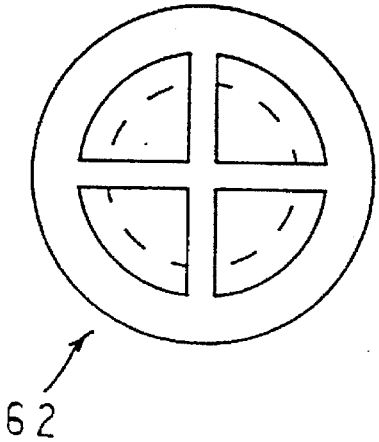
Figure 32D:
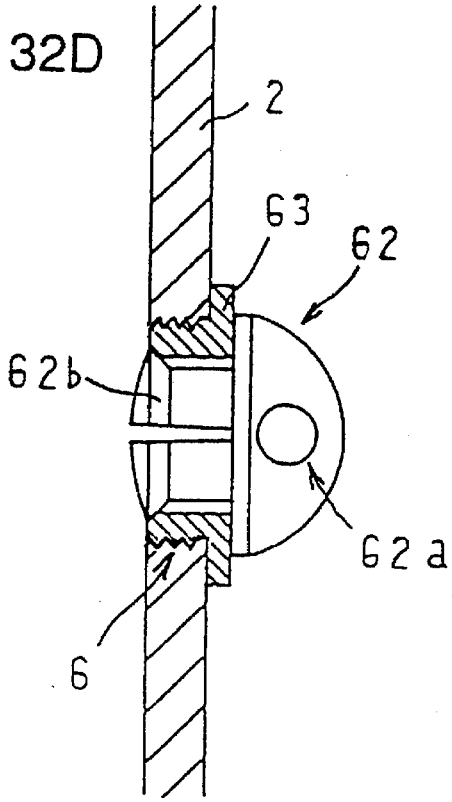

Each of the mounting holes 6, 7 and 13 of the form member body 2 can alternatively be closed by a plug 62 shown in FIGS. 32A to 32D. This plug 62 is provided in the center of its grip portion with a circular opening 62*a*, so that the same can be readily gripped by the fingers of an operator or with a holder in attachment/detachment to/from each mounting hole 6. A portion 62*b* of the plug 62 to be engaged with the mounting hole 6 is divided into four, so that its outer diameter is widened on the forward end. Due to this shape, it is possible to readily reduce the outer diameter of the forward end of the portion 62*b* for engaging the plug 62 in the mounting hole 6, so that the forward end of the engaged portion 62*b* is stopped on the outer peripheral edge of the mounting hole 6 in the engaged state, to reliably fix the plug 62. FIG. 32D is a sectional view showing the plug 62 which is engaged with the mounting hole 6 of the form member body 2 through a mounting hole protective cup 63.

Figure 33A:
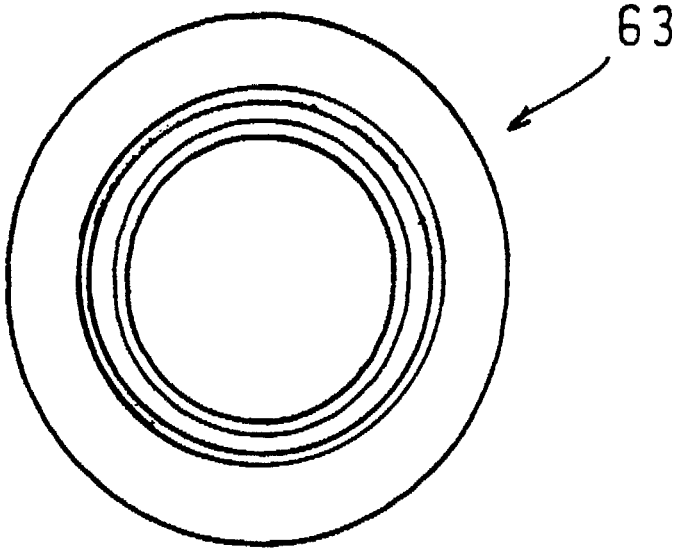
FIG. 33A is a plan view of a mounting hole protective cup 63 for protecting a separator mounting hole provided in a form member or the like, and FIG. 33B is a front elevational view thereof.
Figure 33B:
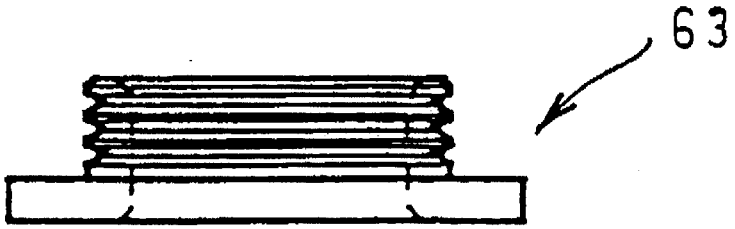

The mounting hole protective cup 63, which is shaped as shown in FIGS. 33A and 33B, is made of a metal such as stainless, for example.

Figure 34A:
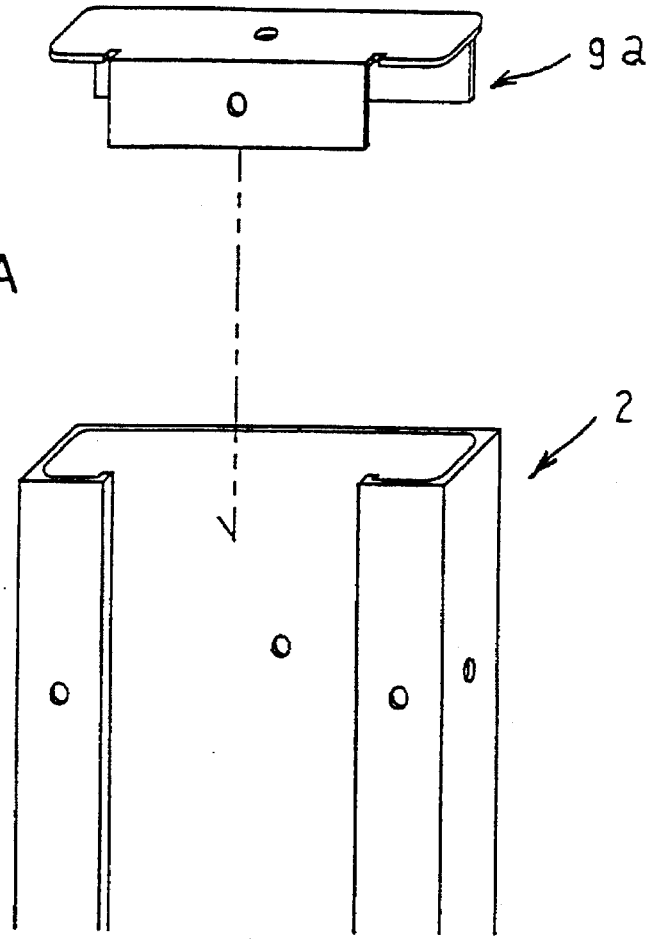
FIG. 34A is an exploded perspective view showing an end plate body 9*a* provided in the concrete molding form member according to the embodiment of the present invention and a portion close to an end of a form member body 2 which is engaged therewith.
Figure 34B:
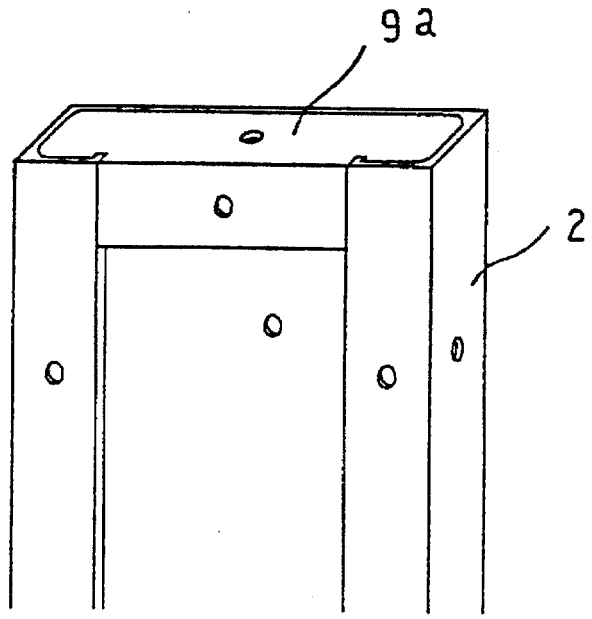
FIG. 34B is a perspective view showing the end plate body 9*a* which is engaged with the end of the form member body 2.
Figure 35A:
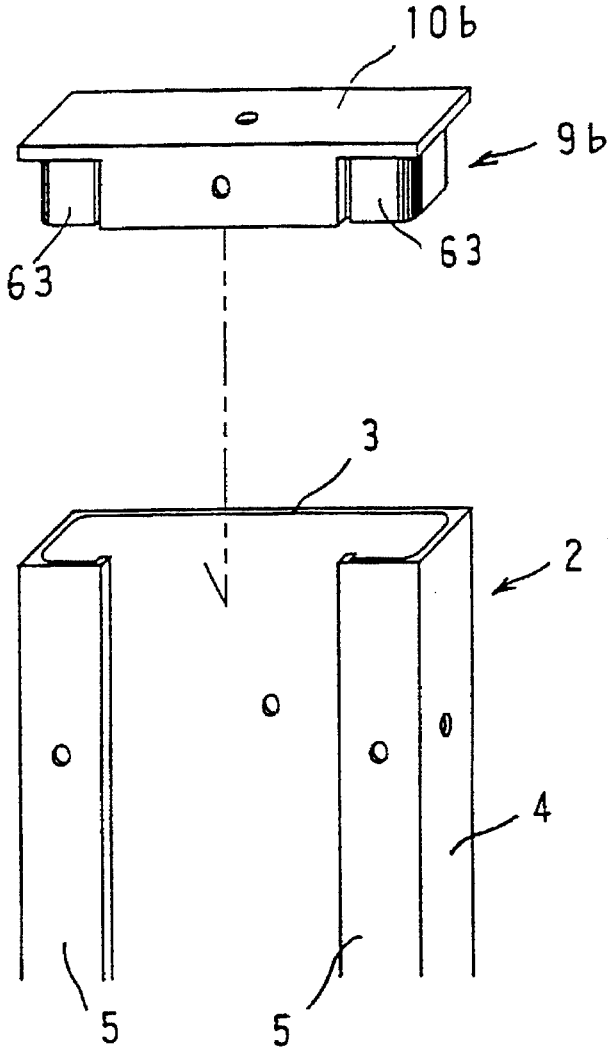
FIG. 35A is an exploded perspective view showing another end plate body 9*b* provided in the concrete molding form member according to the embodiment of the present invention and a portion close to the end of the form member body 2 which is engaged therewith.
Figure 35B:
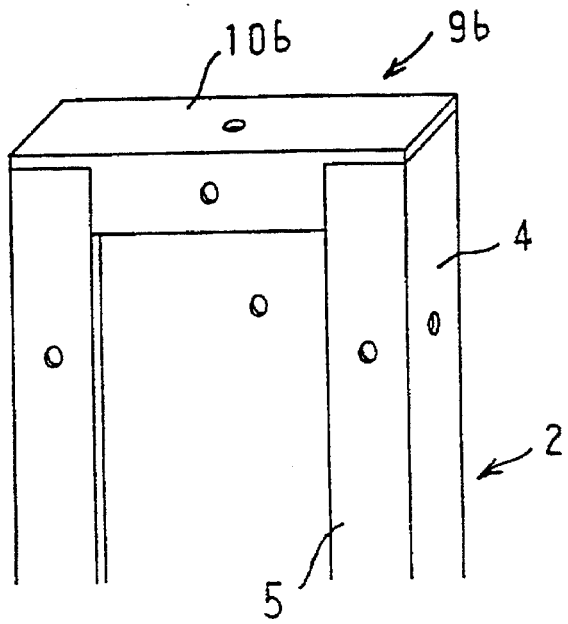
FIG. 35B is a perspective view showing the end plate body 9*b* which is engaged with the end of the form member body 2.

Two modes of each end plate body 9 which is engaged with either end of the form member body 2 are now described with reference to FIGS. 34A, 34B, 35A and 35B. An end plate body 9*a* shown in FIGS. 34A and 34B is formed by folding a single plate in a plane shape which is sized to be engaged with the inner side of the form member body 2, so that an upper end surface of the end plate body 9*a* is bonded/fixed in a state being flush with an end surface of the form member body 2 as shown in FIG. 34B when the end plate body 9*a* is engaged in the end of the form member body 2 as shown in FIG. 34A. In an end plate body 9*b* shown in FIGS. 35A and 35B, on the other hand, an upper plate portion 10*b* is formed to be larger than that of the end plate body 9*a* appearing in FIGS. 34A and 34B as shown in FIG. 35A, so that the upper plate portion 10*b* entirely covers the end surface of the form member body 2 in engagement with the end portion thereof, as shown in FIG. 35B. Further, the upper plate portion 10*b* is provided on lower portions of its horizontal sides with a pair of engaging portions 63 which are inserted and engaged in the space enclosed with the front plate portion 3, the side plate portions 4 and the rear plate portions 5 of the form member body 2, so that the outer peripheral side portions of the end plate body 9*b* and the inner peripheral side portions of the form member body 2 are substantially entirely in contact and engaged with each other, thereby improving the strength at the end portion of the form member 1.

Description is now made on a form member connector which is employed for connecting the form members 1 according to this embodiment with the connectors 21 and 31 for assembling a concrete molding formwork with reference to FIGS. 9 to 14, 36, 37A and 37B.

Figure 9:
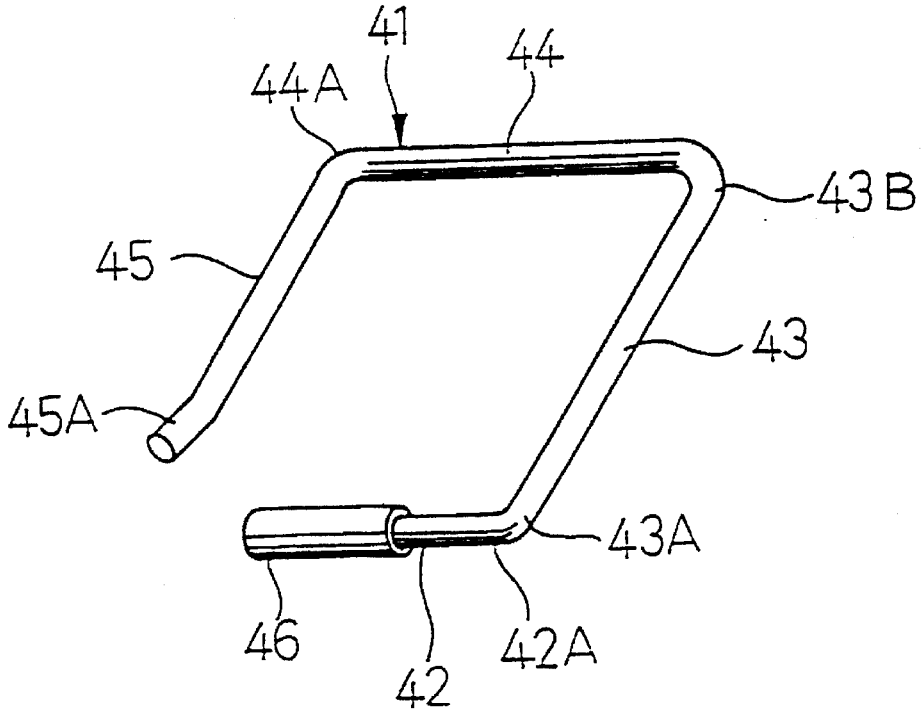
FIG. 9 is a perspective view showing the appearance of a form member connecting clip.
Figure 10:
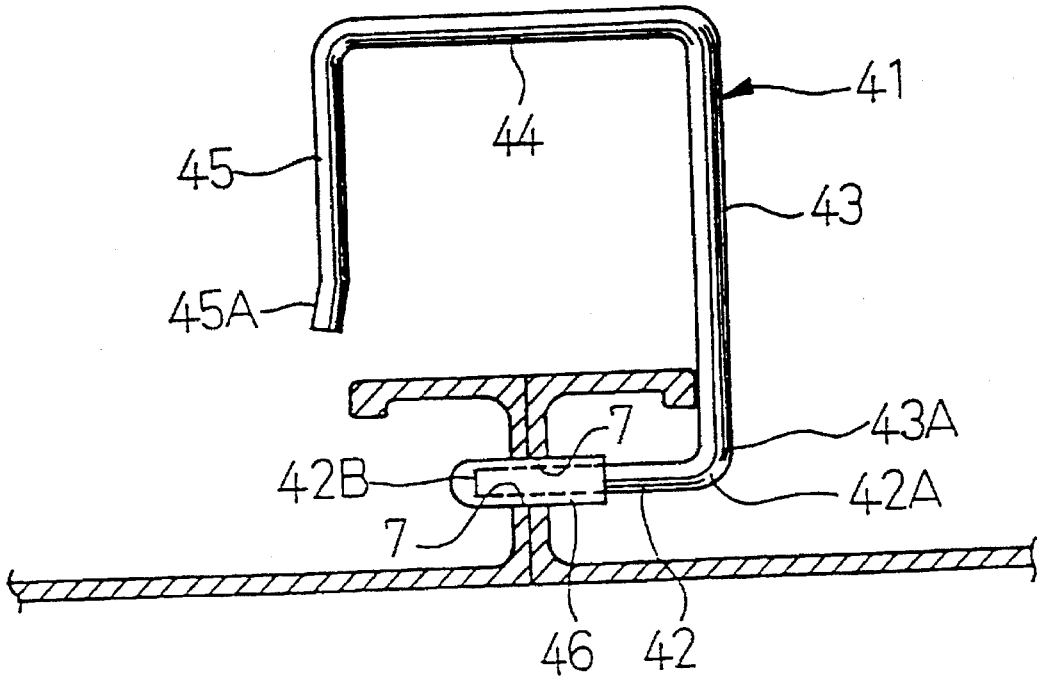
FIG. 10 is a sectional view showing the form member connecting clip whose insertional shaft is inserted in mounting holes of connected portions of concrete molding form members in an enlarged manner.

FIGS. 9 to 11 show a form member connecting clip 41, as a first exemplary form member connector. This form member connecting clip 41 comprises an insertional shaft portion 42, a first holding portion 43, a grip portion 44 and a second holding portion 45, which are integrally formed by bending an elastic wire. In the insertional shaft portion 42, the length between a base end 42A and a free forward end 42B is set to be longer than the lateral width of each rear plate portion 5 of the form member body 2. A front end 43A of the first holding portion 43 rearwardly extends from the base end 42A of the insertional shaft portion 42 in a perpendicularly bent manner. The grip portion 44 is perpendicularly bent at a rear end 43B of the first holding portion 43, to transversely extend similarly to the insertional shaft portion 42.

The second holding portion 45 is perpendicularly bent at a forward end 44A of the grip portion 44, to be opposed to the first holding portion 43. A forward end 45A of the second holding portion 45 is transversely outwardly bent to define a free end. A synthetic resin spacer 46 having an outer diameter which is receivable in each of the mounting holes 7 and 13 is engaged with the insertional shaft portion 42.

In order to connect/fix a pair of form members 1 with/to each other by the form member connecting clip 41 having the aforementioned structure, the insertional shaft portion 42 is transversely inserted in butted mounting holes 7 (or 13) of the pair of form members 1 which are aligned and brought into contact with each other as shown in FIG. 11, through the spacer 46. In this state, the grip portion 44 is gripped and rotated either clockwise or anticlockwise about the insertional shaft portion 42, so that a pair of rear plate portions 5 are held between the first and second holding portions 43 and 45. The form member connecting clip 41 may be made of synthetic resin, in place of the wire.

Figure 36:
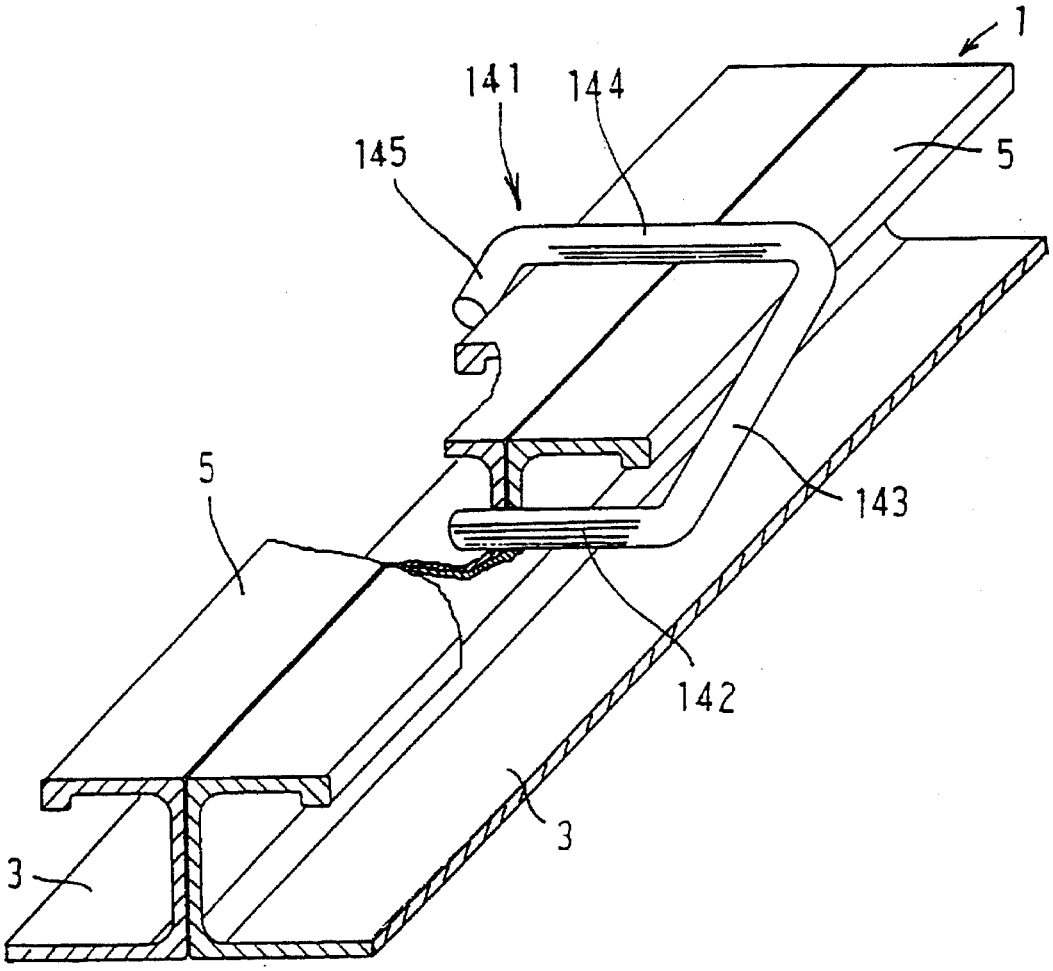
FIG. 36 is a partially fragmented perspective view showing adjacent form members according to the present invention which are connected with/fixed to each other by a form member connecting clip 141 according to a modification.
Figure 37A:
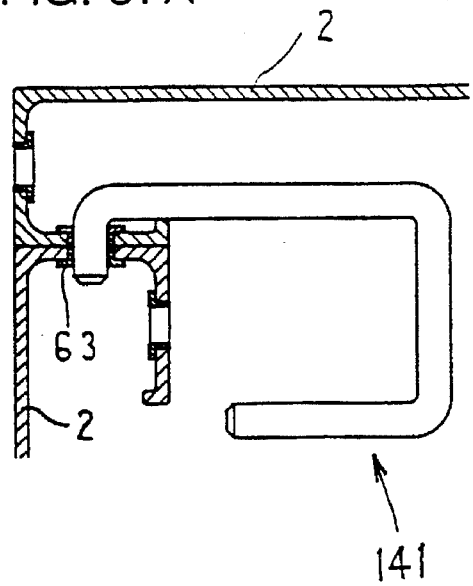
FIGS. 37A and 37B are sectional views showing two modes of connecting/fixing adjacent form member bodies 2 with/to each other by form member connecting clips 14 of the same shape in enlarged manners.
Figure 37B:
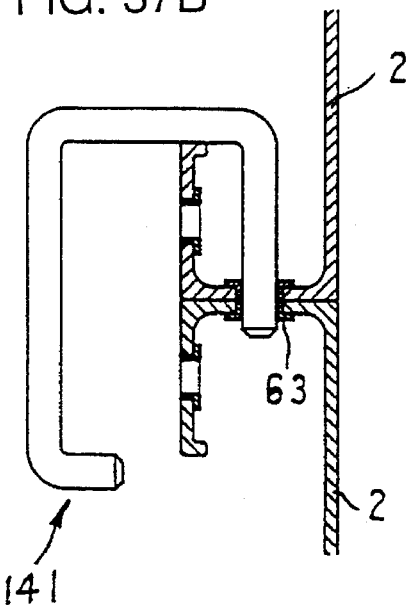
Figure 37C:
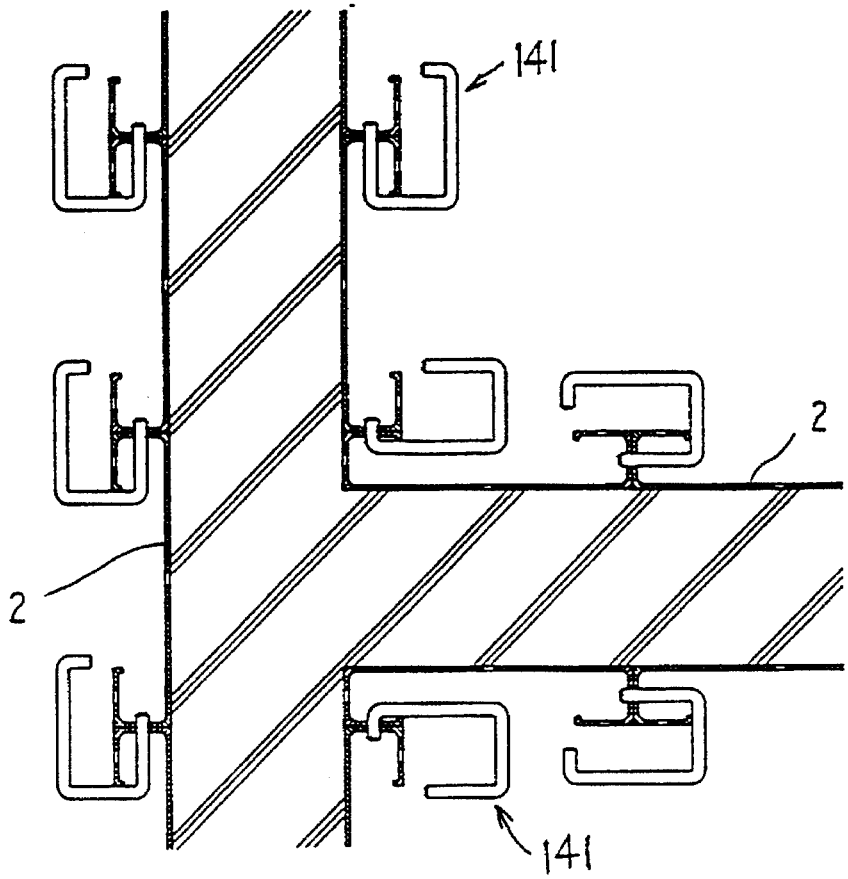
FIG. 37C is a plan sectional view showing a plurality of form member bodies 2 which are connected with/fixed to each other in the two modes shown in FIGS. 37A and 37B for forming a T-shaped concrete molding formwork.

It is also possible to employ a form member connecting clip 141 shown in FIG. 36 as the form member connecting member. This form member connecting clip 141 has an insertional shaft portion 142, a first holding portion 143, a grip portion 144 and a second holding portion 145 corresponding to the insertional shaft portion 42, the first holding portion 43, the grip portion 44 and the second holding portion 45 of the aforementioned form member connecting clip 41 respectively. However, this form member connecting clip 141 has no portion corresponding to the synthetic resin spacer 46 or the bent forward end 45A of the second holding portion 45 provided in the form member connecting clip 41. It is possible to apply this form member connecting clip 141 to two types of form member connecting portions shown in FIGS. 37A and 37B, by properly setting the lengths of the respective portions. FIG. 37C shows a plan view showing an exemplary T-shaped concrete molding formwork which is assembled through the same type of form member connecting clips 141 in such two modes. Referring to FIGS. 37A to 37C, the insertional shaft portion 142 or the second holding portion 145 of each form member connecting clip 141 is inserted in each mounting hole of each form member body 2 through a mounting hole protective cup 63 to be temporarily tacked thereto, so that the clip 141 is rotated about the inserted portion in connection/fixation, to be fixed while holding the rear plate portions 5 of the pair of form members 1 as shown in FIG. 36. Such a form member connecting clip 41 can be formed by simply folding a single metal bar or the like to be applicable in two different modes, whereby the cost for the connecting member can be reduced.

Figure 12:
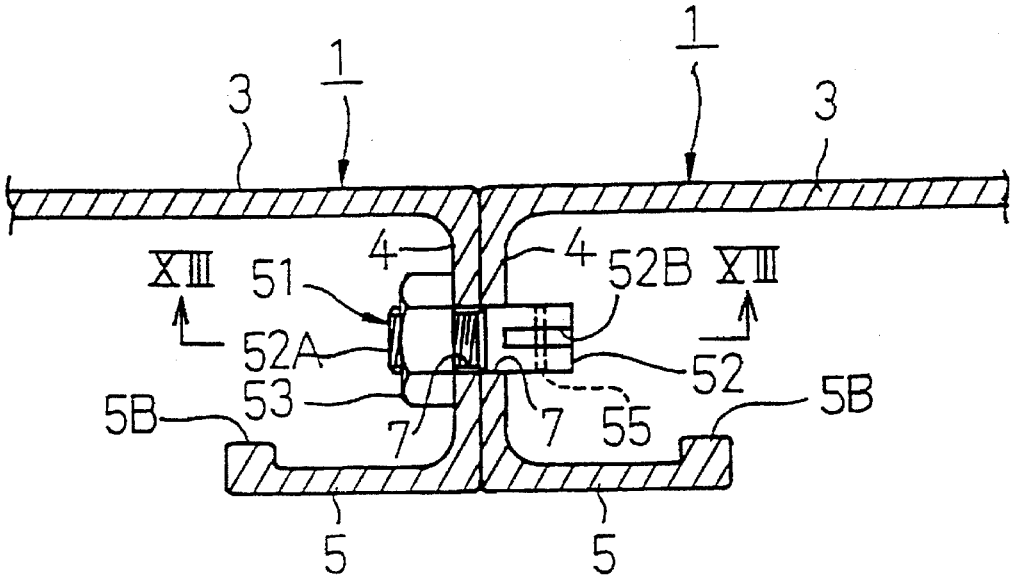
FIG. 12 is a sectional view showing concrete molding form members which are fastened to each other with a form member connecting bolt in an enlarged manner.
Figure 13:
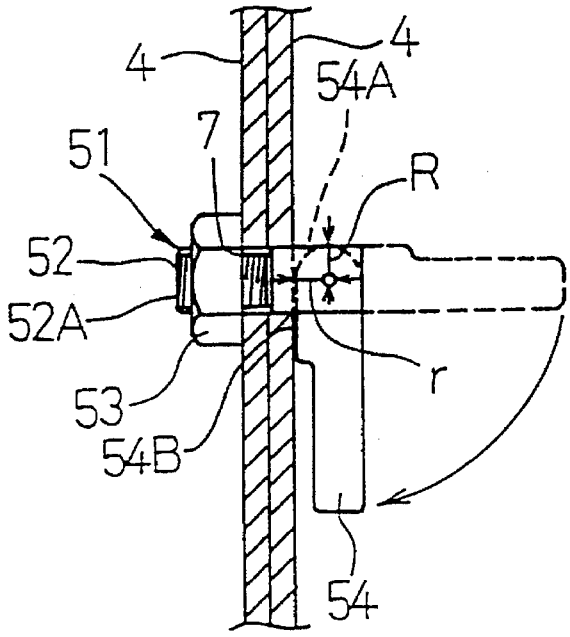
FIG. 13 is a sectional view taken along the line XIII—XIII in FIG. 12.
Figure 14:
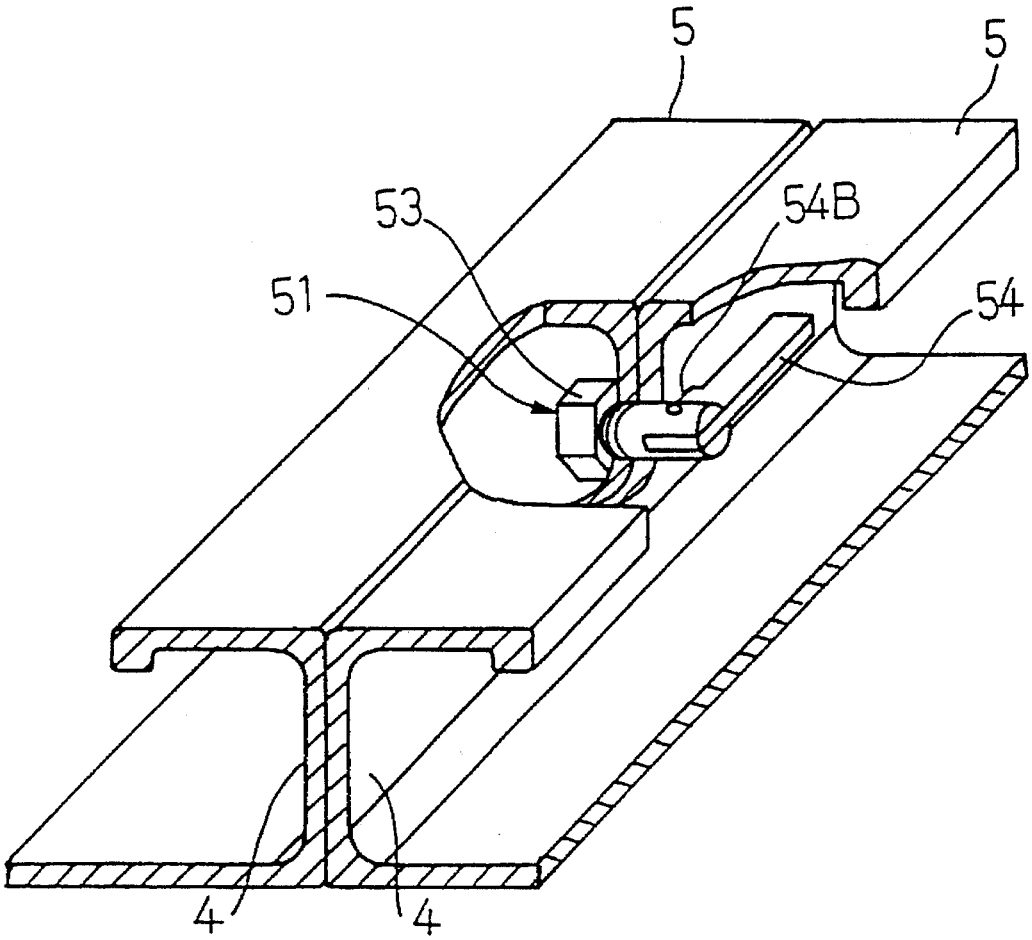
FIG. 14 is a partially fragmented enlarged perspective view for illustrating a state of employment of the form member connecting bolt.

FIGS. 12 to 14 show a form member connecting bolt 51 as a second exemplary form member connecting portion. This form member connecting bolt 51 comprises a bolt body 52, a nut 53 and a clamp lever 54. The bolt body 52 is provided on its first and second ends with a male screw portion 52A and an expanding slot 52B respectively. The nut 53 is fitted with the male screw portion 52A and rotated about the axis of the bolt body 52, to be reciprocative along the axial direction. The clamp lever 54 has a bent surface 54A provided on its longitudinal forward end and a clamp surface 54B defined by its side surface. This clamp lever 54 is coupled through a pin 55 in a state engaged in the expanding slot 52B of the insertional shaft portion 52, to be rotatable about the pin 55. The distance r between the pin 55 and the clamp surface 54B is set to be slightly longer than the distance R between the same and the longitudinal forward end of the clamp lever 54 so that the pin 55 is eccentric, whereby clamping force acts upon rotation of the clamp lever 54.

Figure 15:
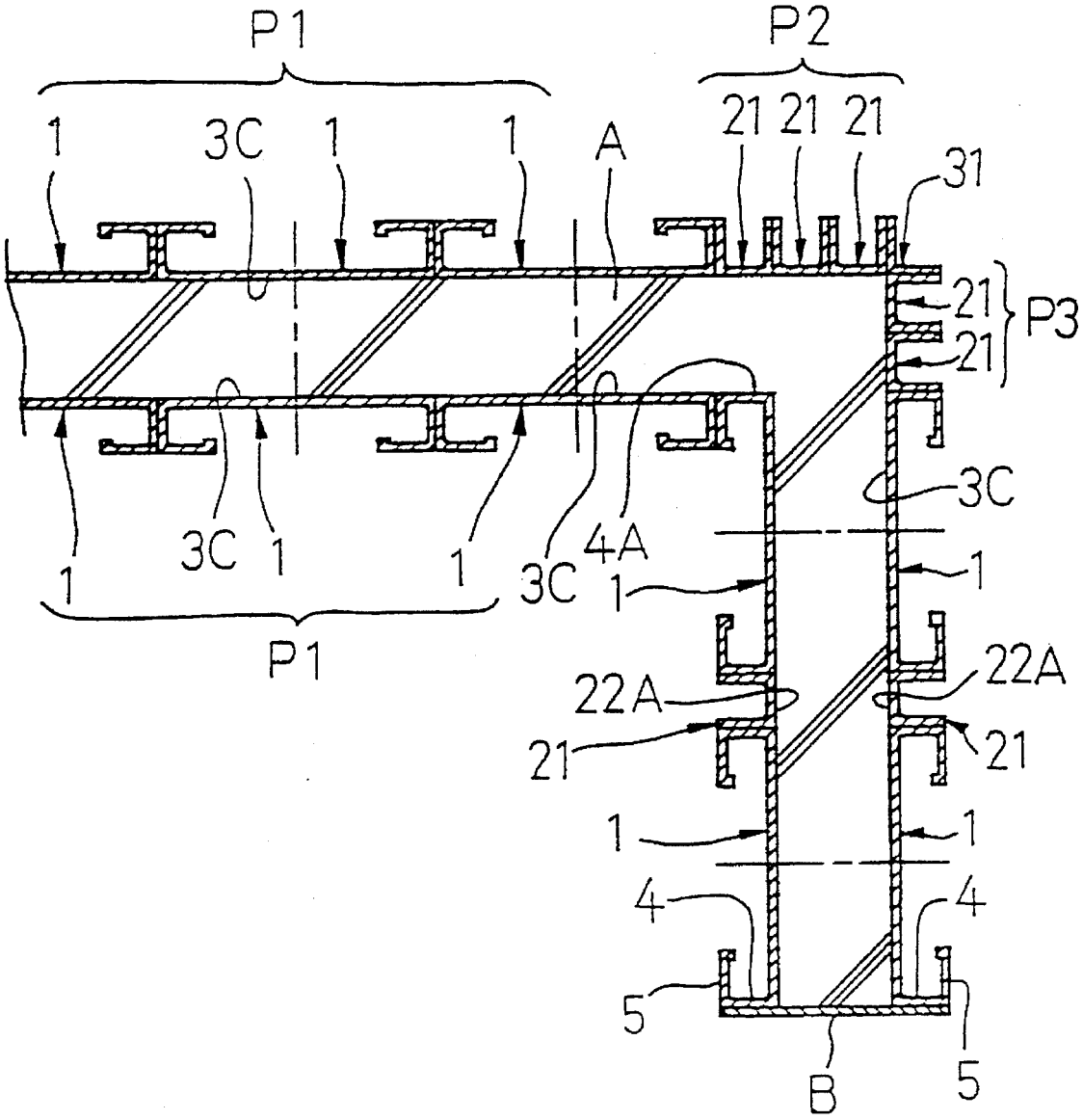
FIG. 15 is a cross-sectional view showing an exemplary assembled state of an L-shaped form panel.

Description is now made on an exemplary assembly of form members 1 and connectors 21 and 31 with the aforementioned form member connecting clips 41 and form member connecting bolts 51. FIG. 15 shows an exemplary structure of a formwork for molding a concrete foundation A. Referring to FIG. 15, illustration of the form member connecting clips 41 and the form member connecting bolts 51 is omitted. In this exemplary structure, a plurality of form members 1 are connected with each other so that cross sections thereof extend linearly thereby forming a pair of flat panels P1, and a first angular corner panel P2 is formed by connecting three U-shaped connectors 21 with each other on one side surface of an L-shaped angular corner, while a second angular corner panel P3 is formed by connecting two U-shaped connectors 21 with each other. The angular corner panels P2 and P3 are connected with each other by an L-shaped connector 31. As shown in FIG. 15, it is possible to set the flat panels P1 at desired lengths by interposing the U-shaped connectors 21 between the form members 1 which are so arranged that cross sections thereof extend linearly. An end portion is closed with a plywood board B which is fixed to side plate portions 4 of the endmost form members 1. Referring to FIG. 15, one-dot chain lines show positions for mounting separators.

In the aforementioned exemplary structure shown in FIG. 15, surfaces 3C and 4A of the front plate portions 3 and the side plate portions 4 serve as concrete molding surfaces in the form members 1, while surfaces 22A of base plate portions 22 serve as concrete molding surfaces and surfaces 23A of connecting plate portions 23 serve as connecting surfaces in the U-shaped connectors 21 respectively.

Figure 16:
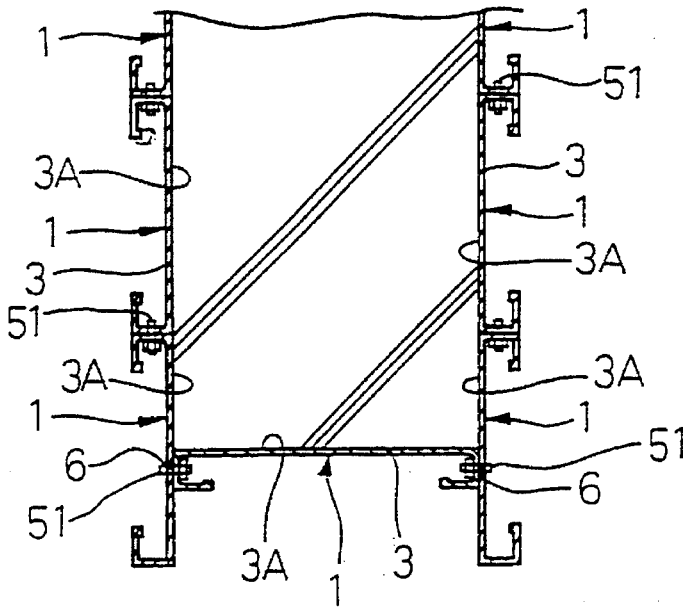
FIG. 16 is a sectional view showing an additional form member which is mounted between a pair of opposite form members.

FIG. 16 shows such an exemplary structure that an opposite pair of form members 1 are connected with/fixed to each other by an additional form member 1 which is perpendicularly combined therewith. Namely, the additional form member 1 is perpendicularly built into a clearance between the opposite form members 1 through the mounting holes 6 which are adapted to receive separators in general. In this exemplary structure, surfaces 3C of the opposite front plate portions 3 serve both as concrete molding surfaces and connecting surfaces.

Figure 17:
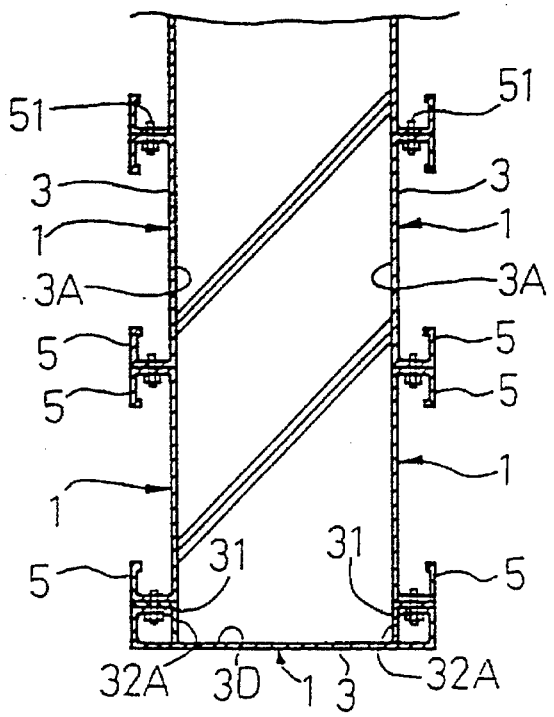
FIG. 17 is a sectional view showing the appearance of an additional form member which is connected to ends of a pair of opposite form members.

FIG. 17 shows another exemplary structure which is different from the above. In this exemplary structure, rear plate portions 5 of an additional form member 1 are connected to side plate portions 4 of an opposite pair of form members 1 while clearances between the rear plate portions 5 and the back surface 3D of the front plate portion 3 of the additional form member 1 are closed with L-shaped connectors 31, thereby forming flat surfaces which are flush with opposite front plate portions 3. According to this exemplary structure, the back surface 3D of the front plate portion 3 which is positioned on the end portion and first surfaces 32A of the L-shaped connectors 31 serve as concrete molding surfaces.

Figure 18:
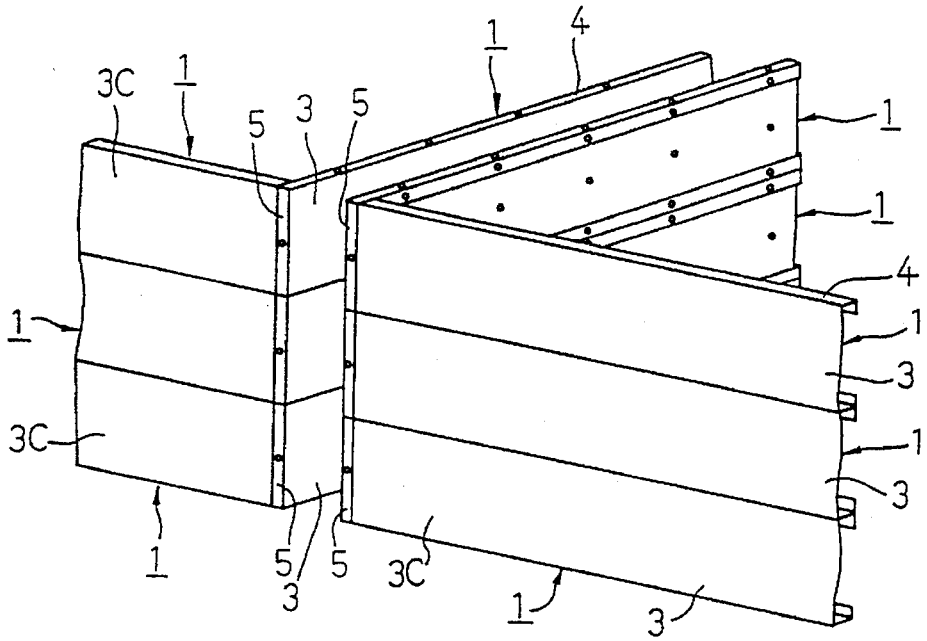
FIG. 18 is a perspective view showing the appearance of concrete molding form members which are transversely arranged and assembled with each other in a T-shaped state.

In order to form the foundation for a residence by the form members 1, for example, a plurality of form members 1 may be longitudinally connected with each other in transversely directed states as shown in FIG. 18. In this case, surfaces 10A of end plate portions 10 of end plate bodies 9 also serve as concrete molding surfaces.

Figure 19:
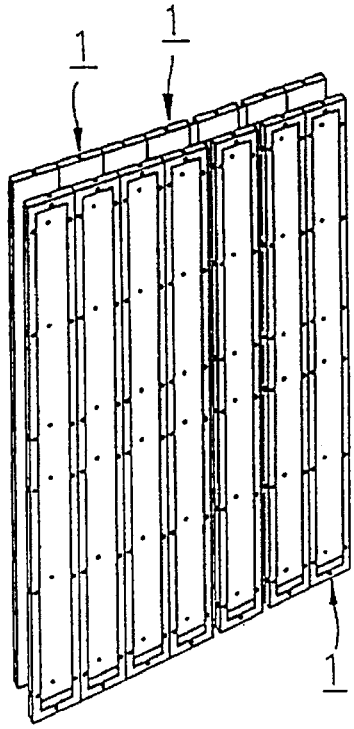
FIG. 19 is a perspective view showing the appearance of concrete molding form members which are vertically arranged and assembled with each other in a linear state.
Figure 20:
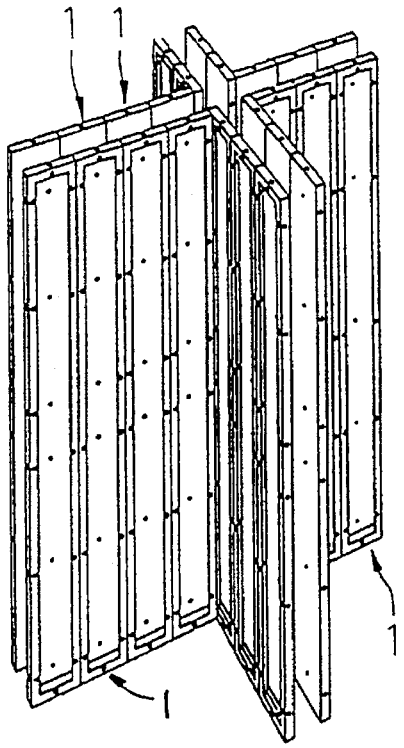
FIG. 20 is a perspective view showing the appearance of concrete molding form members which are vertically arranged and assembled with each other in a cross state.
Figure 21:
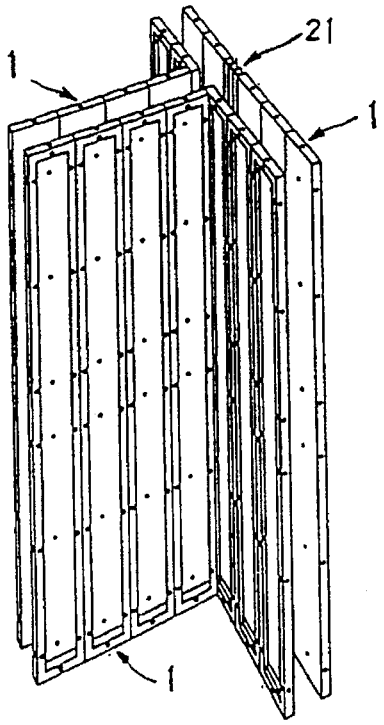
FIG. 21 is a perspective view showing the appearance of concrete molding form members which are vertically arranged and assembled with each other in a T-shaped state.
Figure 22:
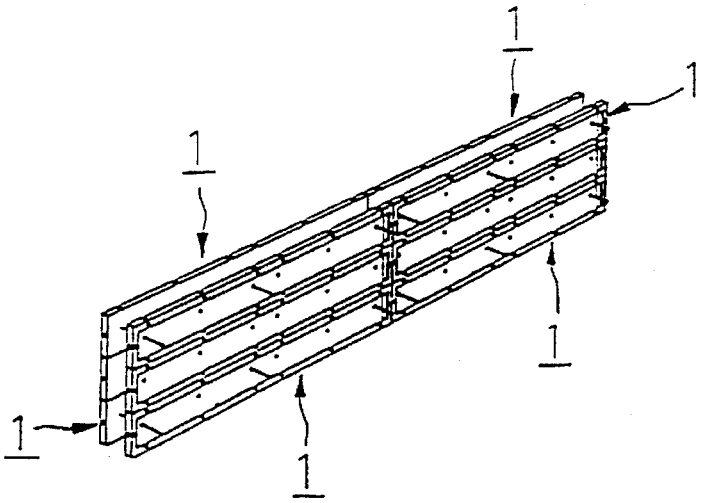
FIG. 22 is a perspective view showing the appearance of concrete molding form members which are transversely arranged and assembled with each other in a linear state.

Description is now made on appearances in finished states of concrete molding form panels which are assembled in various shapes by the form members 1 according to this embodiment and the connectors 21 and 31 with reference to FIGS. 19 to 25. FIG. 19 shows an exemplary structure of concrete molding form panels formed by vertically assembling form members 1 with each other so that cross sections thereof extend linearly. In this exemplary structure, surfaces 4A of side plate portions 4 serve as connecting surfaces. FIG. 20 shows an exemplary structure of form panels which are formed by assembling form members 1 in the form of a cross, so that surfaces 4A and 5A of side plate portions 4 and rear plate portions 5 serve as connecting portions at angular corners respectively. FIG. 22 shows an exemplary structure of form panels which are formed by assembling form members 1 in a T shape, so that surfaces 4A and 5A of side plate portions 4 and rear plate portions 5 serve as connecting portions at angular corners respectively. In this exemplary structure, triple U-shaped connectors 21 are employed to adjust the dimensions of the form panels.

Figure 23:
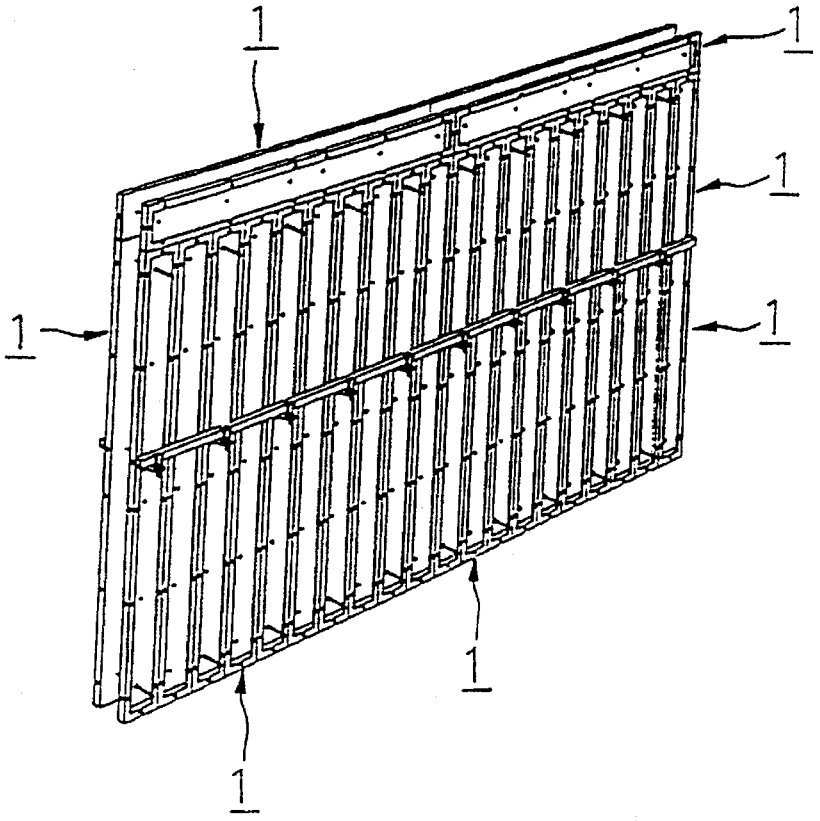
FIG. 23 is a perspective view showing the appearance of linear concrete molding form members which are vertically and transversely arranged in lower and upper sides respectively and assembled with each other.
Figure 24:
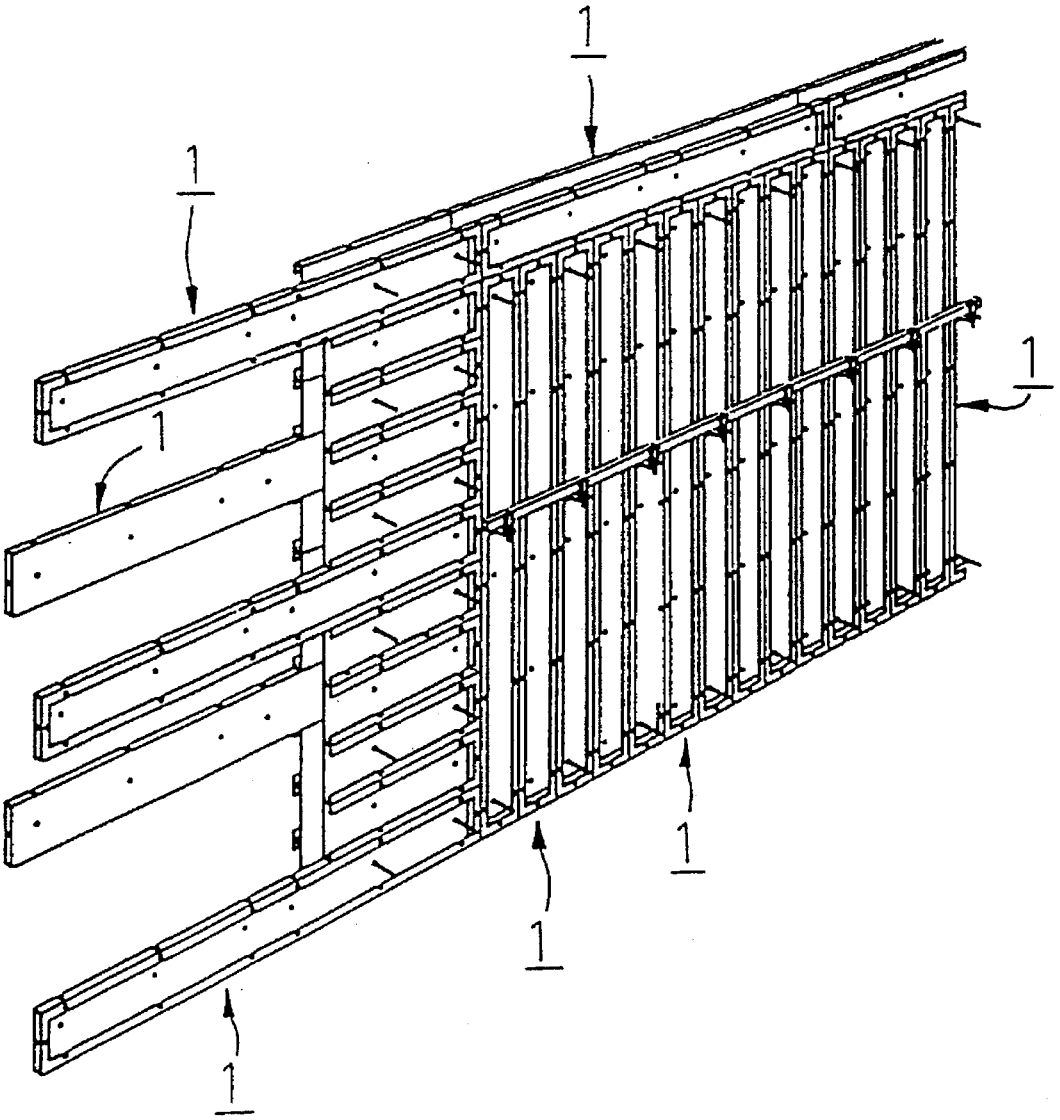
FIG. 24 is a perspective view showing the appearance of concrete molding form members which are vertically and transversely arranged and connected with each other.
Figure 25:
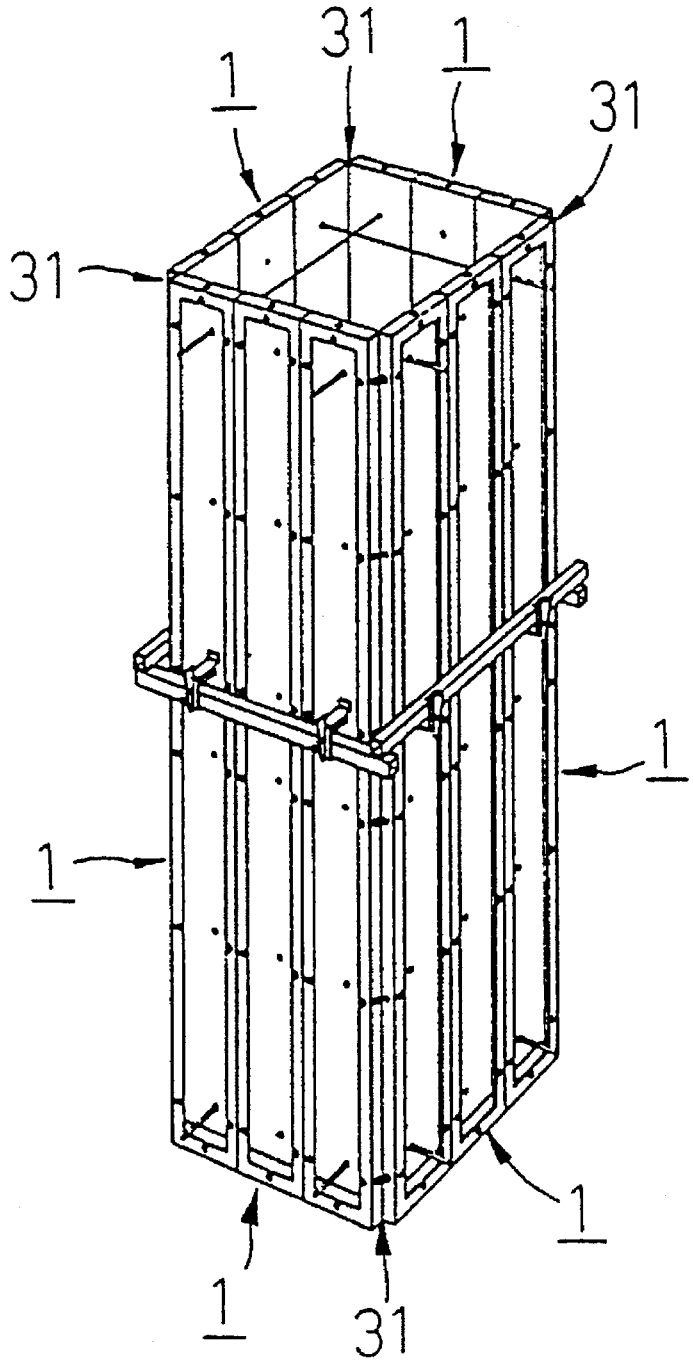
FIG. 25 is a perspective view showing the appearance of concrete molding form members which are assembled in a hollow prism state.

FIG. 22 shows an exemplary structure of form panels which are formed by assembling transversely directed form members 1 with each other so that surfaces 4A and 10A of side plate portions 4 and end plate portions 10 serve as connecting surfaces. FIG. 23 shows an exemplary structure of form panels which are formed by transversely connecting form members 1 with upper ends of vertically directed form members 1 so that surfaces 4A of side plate portions 4 as well as surfaces 4A and 10A of the strip side plate portions 4 and end plate portions 10 serve as connecting surfaces respectively. FIG. 24 shows an exemplary structure of form panels which are formed by transversely connecting form members 1 with vertically connected form members 1 so that surfaces 4A and 10A of side plate portions 4 and end plate portions 10 serve as connecting surfaces respectively. FIG. 25 shows an exemplary structure of form panels which are formed by assembling form members 1 in the form of a hollow prism for molding a pillar, so that four panels which are formed by triple form members 1 are connected with each other by four L-shaped connectors 31. In this exemplary structure, surfaces 4A and 32A of side plate portions 4 and connecting plate portions 32 serve as connecting surfaces.

Figure 26:
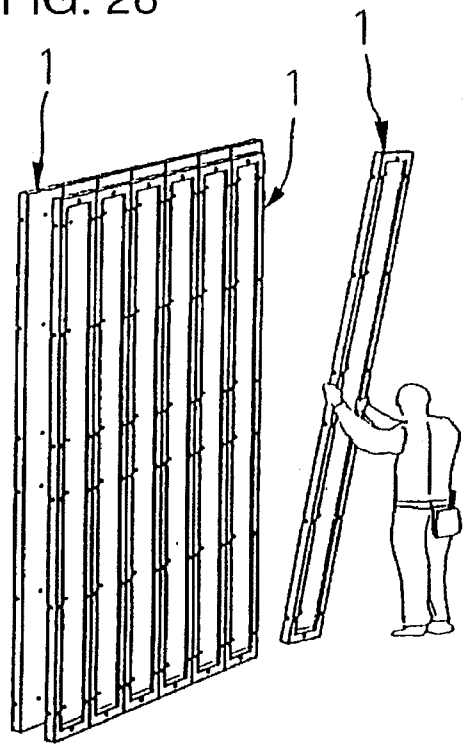
FIG. 26 illustrates a state of executing concrete molding form members.

As hereinabove illustrated, it is possible to assemble concrete molding form panels of various structures by employing the form members 1 according to this embodiment, while the form member 1 according to this embodiment is not only capable of forming the aforementioned various structures but has excellent strength as compared with the conventional wood, synthetic resin and metal form members, and can be reduced to about ⅓ in weight in the same shape. Consequently, it is possible to lengthen the form member 1 to the maximum size which can be handled by a single operator, thereby increasing the area of each form member. Therefore, a single operator can assemble a single stage form panel with no footstool, as shown in FIG. 26. Due to the high strength, further, it is not necessary to support a plurality of form members 1 which are connected in parallel with each other by square bar-shaped support members for transversely bridging and fixedly supporting the same, but extremely excellent workability can be attained.

Figure 27:
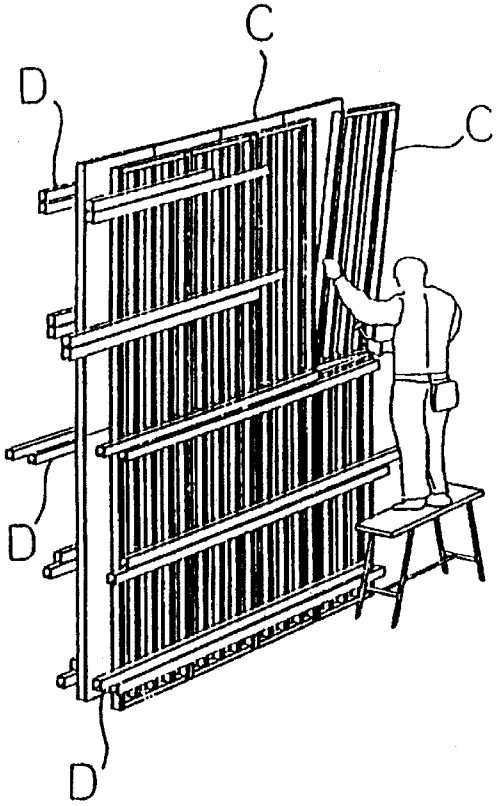
FIG. 27 PRIOR ART
FIG. 27 illustrates a state of executing conventional wood form members.
Figure 28:
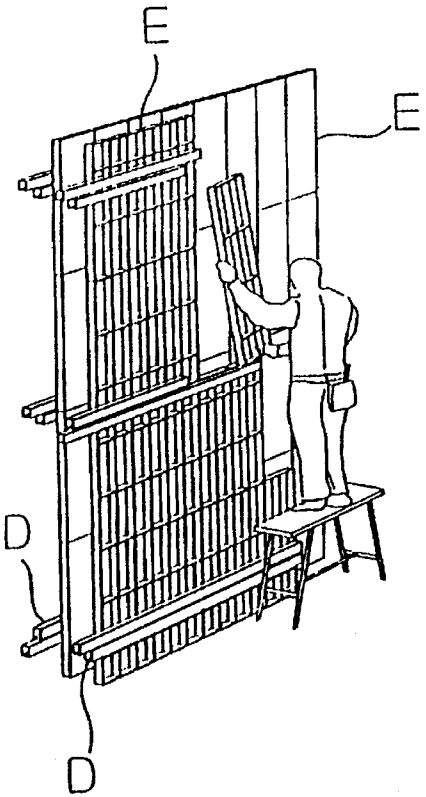
FIG. 28 PRIOR ART
FIG. 28 illustrates a state of executing conventional metal form members.

When conventional wood form members (or synthetic resin form members) C shown in FIG. 27 are employed, on the other hand, it is necessary to assemble the same in two stages with a footstool since the length of a form member which can be handled by a single operator is limited due to the weight thereof, leading to inferior workability. Further, it is necessary to support the form members C by square bar-shaped support members D, due to requirement in view of strength. In the case of metal form members E shown in FIG. 28, further, the length of a form member which can be handled by a single operator is limited to half that of the wood form member due to its heavy weight, although the form member has high strength. Thus, it is necessary to assemble the form members E in four stages with a footstool, leading to the most inferior workability. Thus, the form member 1 according to this embodiment and the connectors 21 and 31 not only enable combinations which cannot be attained by the conventional form members, but can remarkably improve workability in assembling and demolition.

Figure 38:
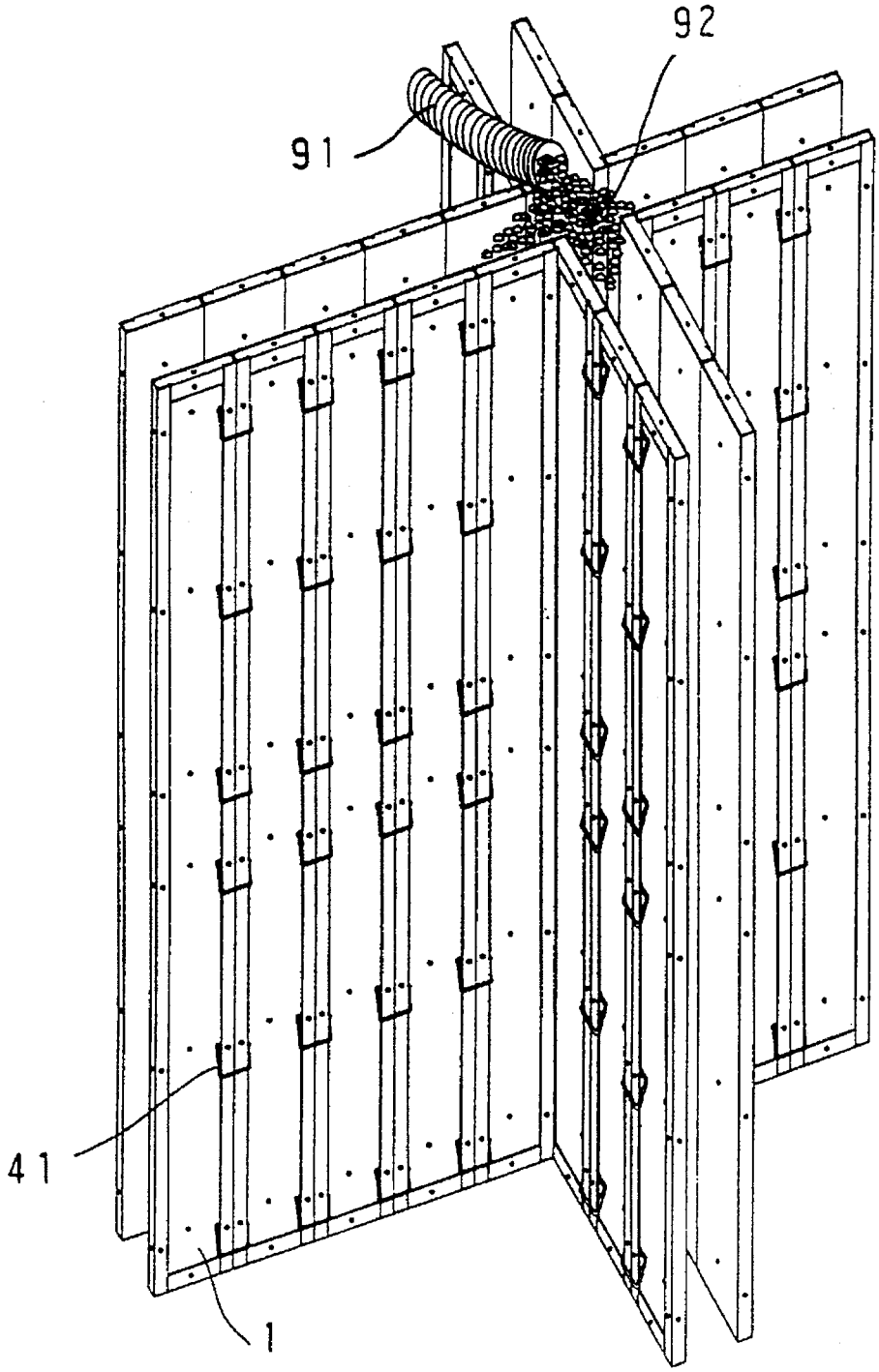
FIG. 38 is a perspective view showing a concrete formwork having a cross concrete molding portion which is obtained by connecting/fixing a plurality of concrete molding form members 1 according to the embodiment of the present invention with/to each other by form member connectors 41, and concrete which is placed therein.

FIG. 38 shows a state of placing concrete 92 from a concrete supply pipe 91 into a concrete formwork having a cross concrete molding portion which is formed by connecting/fixing a plurality of form members 1 according to this embodiment with/to each other through form member connectors 41.

While the end plate bodies 9 are provided on the form member body 2 in the form member 1 according to this embodiment, the form member 101 provided with no end plate bodies 9 may alternatively be employed as shown in FIG. 29, when the form member 101 is used in a vertically directed state. In this case, it is possible to partially cut the form member 101 at need.

The dimensions of the form members 1 and 101 according to the aforementioned embodiments are not univocally decided but the respective dimensions such as the lengths and/or the widths can be properly set such that a plurality of form members having different dimensions may be previously prepared so that various form members are employed at need.

Description is now made on an embodiment of a form member space holder for fixing opposite form members to each other with a prescribed space in order to assemble a concrete formwork by the form members according to the present invention, with reference to FIGS. 39 to 42D.

Figure 39:
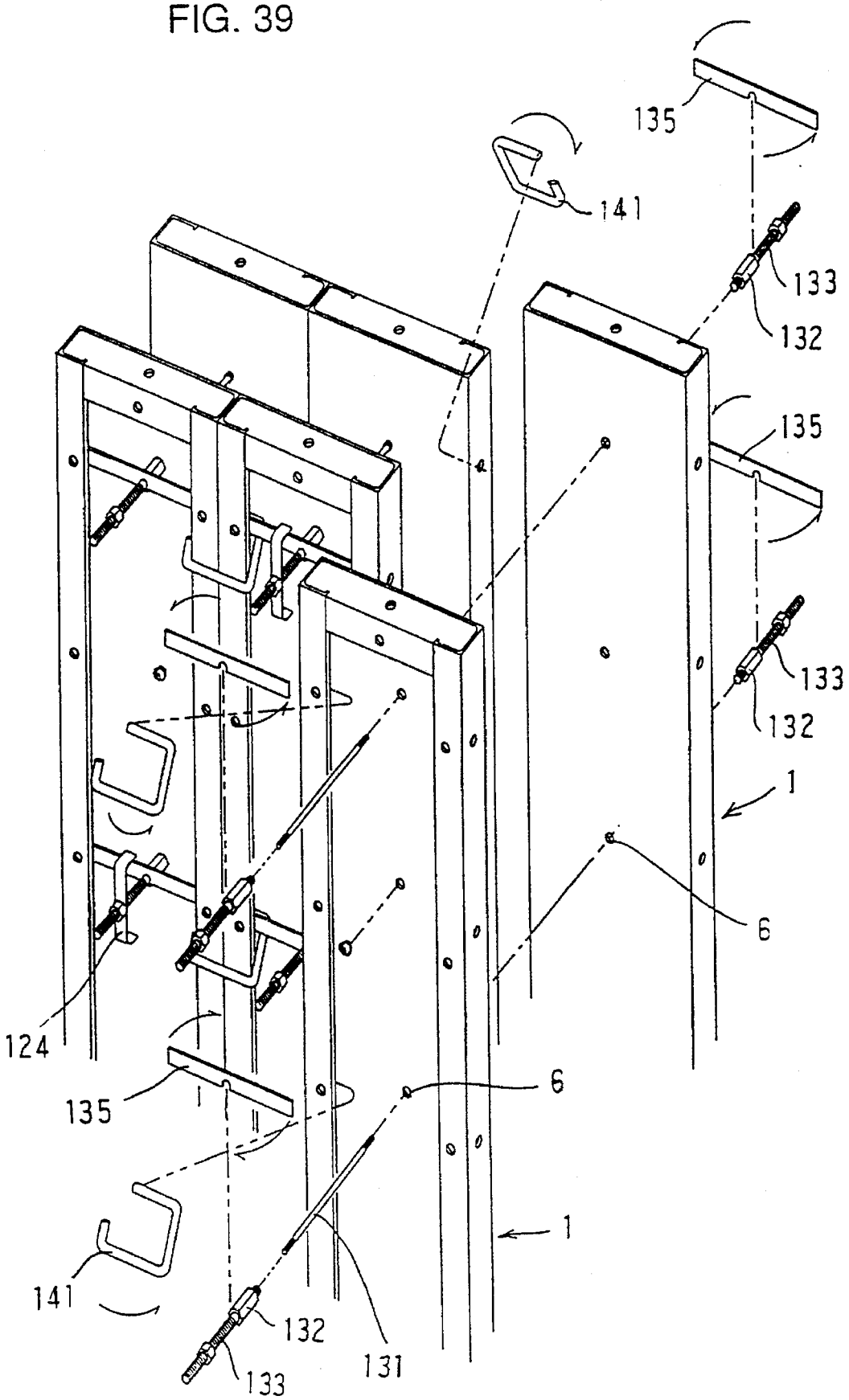
FIG. 39 is an exploded perspective view showing opposite form members which are assembled with each other by form member space holders according to an embodiment of the present invention.
Figure 40:
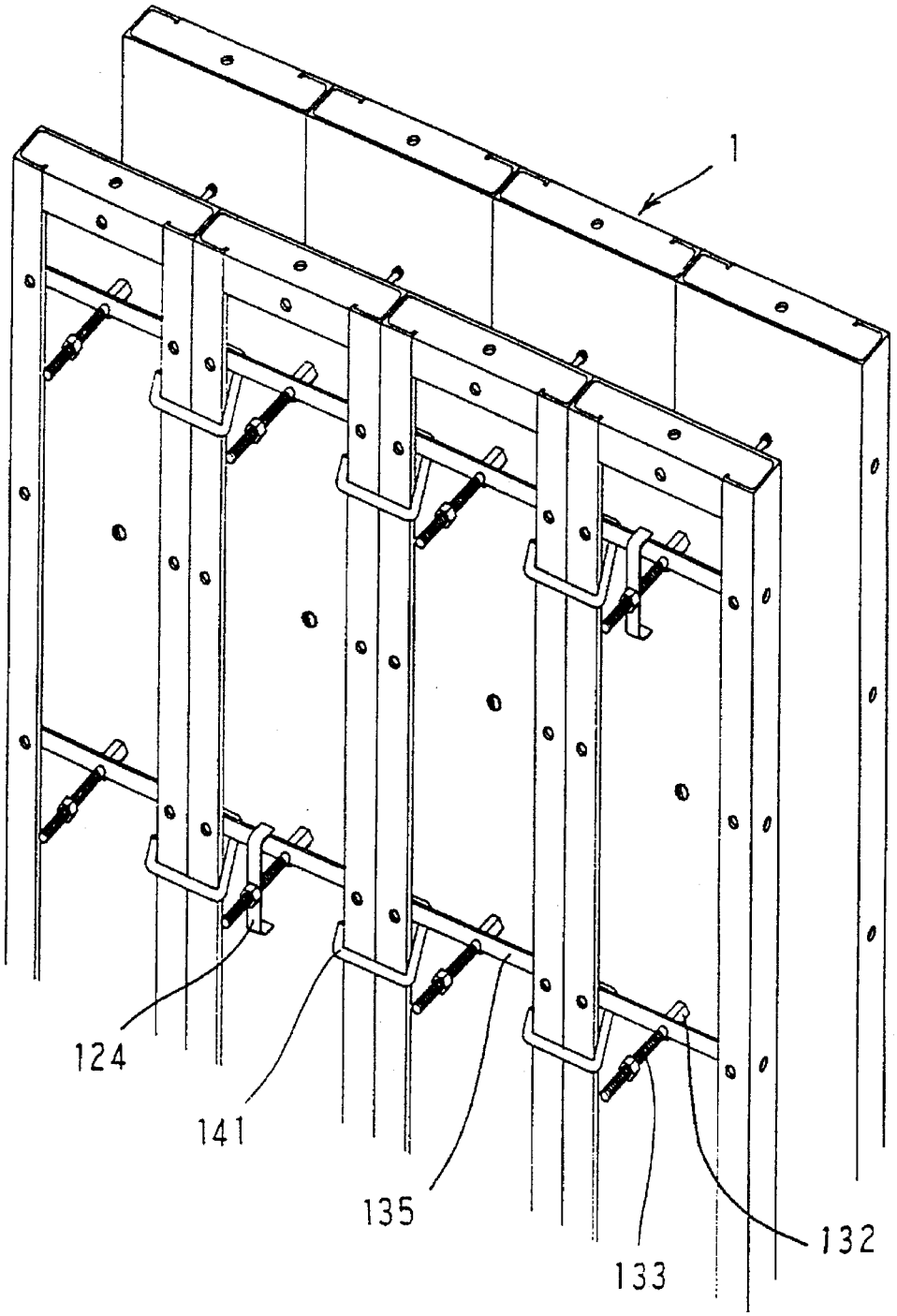
FIG. 40 is a partially fragmented perspective view showing the concrete molding form members which are assembled through the step shown in FIG. 39.

Referring to FIG. 39, a pair of form members 1 are opposed to each other so that positions of corresponding separator mounting holes 6 thereof are aligned with each other while holding a prescribed space therebetween for forming a desired concrete placing portion, and a separator 131 is inserted in each separator mounting hole 6 of one form member 1 so that a pair of attachments 132 and clamp members 133 are mounted on both ends of the separator 131 in each separator mounting hole 6, thereby fixing the form members 1 to each other. Referring to FIG. 39, transversely adjacent form members 1 are connected with/fixed to each other by form member connecting clips 141. FIG. 40 shows such a state that two sets of four form members 1, i.e., eight form members 1 in total, are assembled with each other by the form member space holders according to this embodiment through the concrete placing portion.

Figure 41:
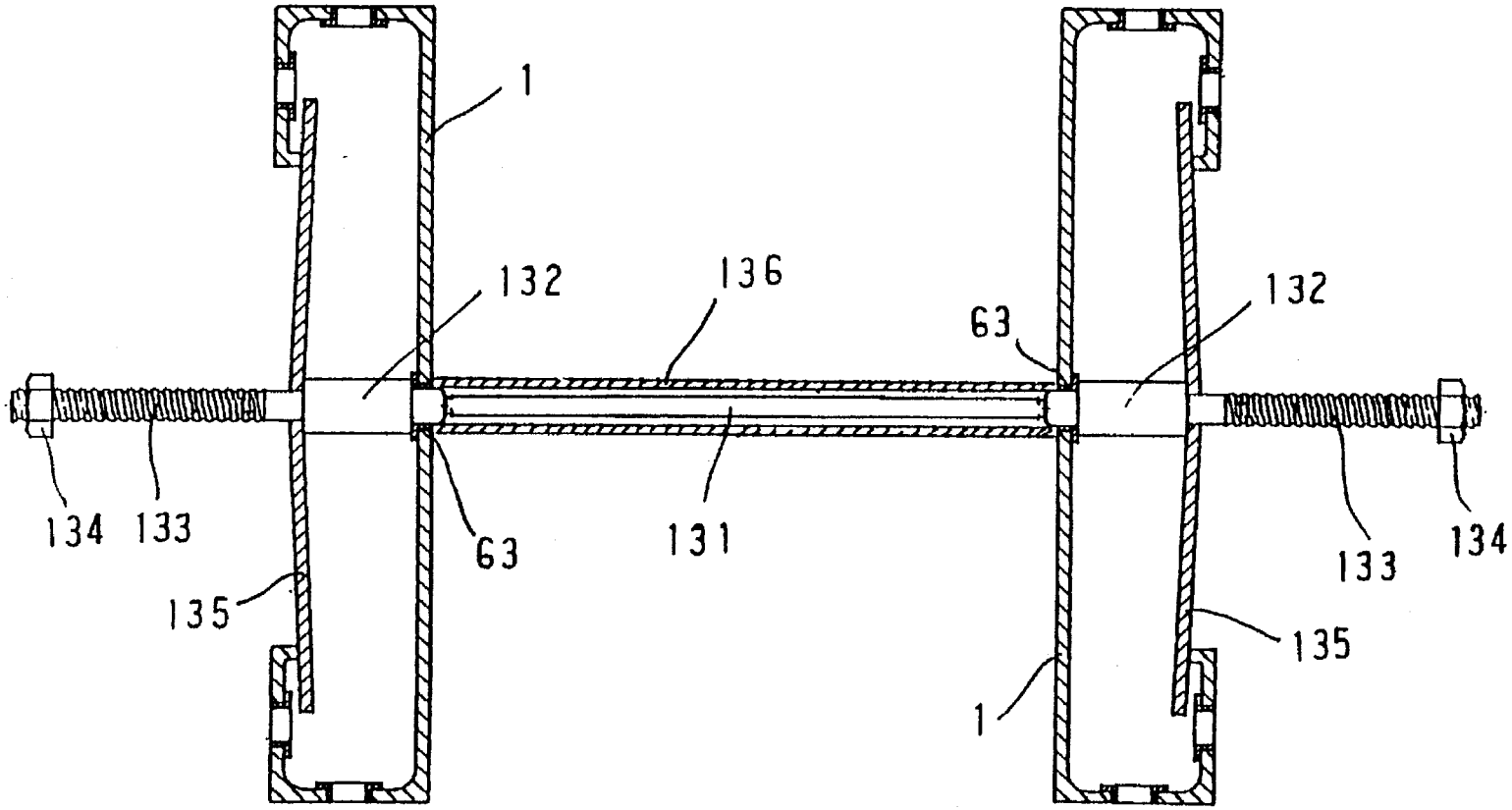
FIG. 41 is a plan sectional view for illustrating an assembling state of each form member space holder according to the embodiment of the present invention shown in FIG. 39.
Figure 42A:
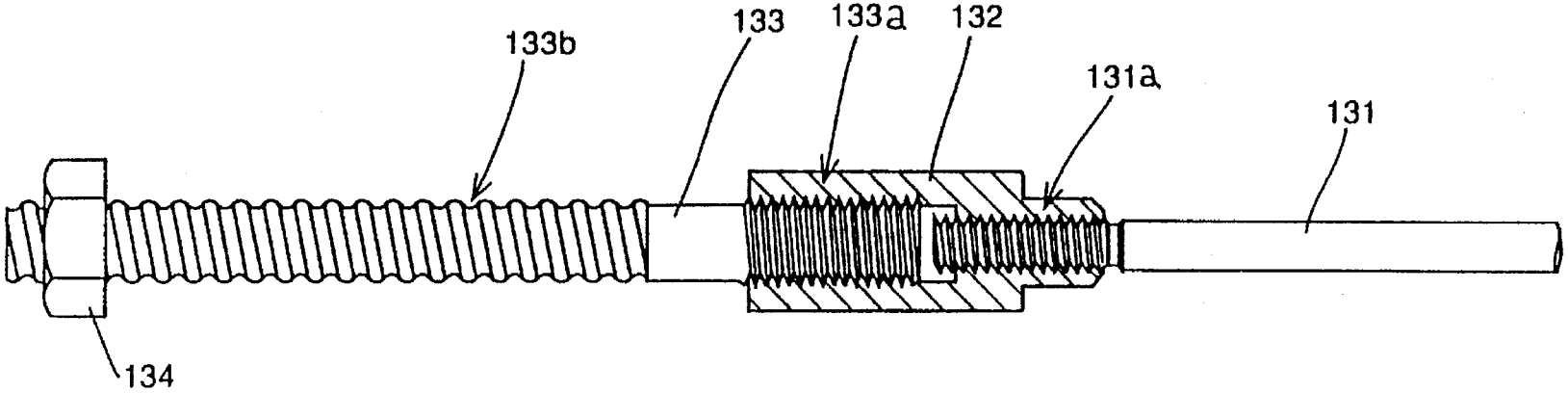
FIG. 42A is a sectional view showing a separator 131, an attachment 132, a clamp member 133 and a nut 134 forming a principal part of the form member space holder according to the embodiment of the present invention appearing in FIG. 41, in a fastened state in assembling.
Figure 42D:
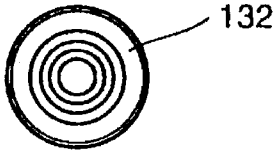
FIGS. 42B, 42C and 42D are a left side elevational view, a front sectional view and a right side elevational view of the attachment 132 respectively.
Figure 42C:
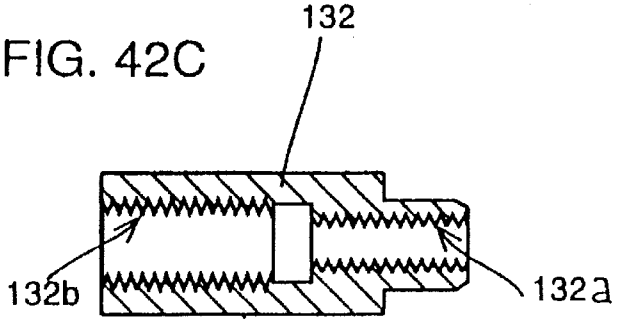
Figure 42B:
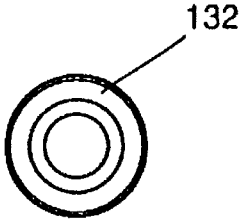
Figure 43:
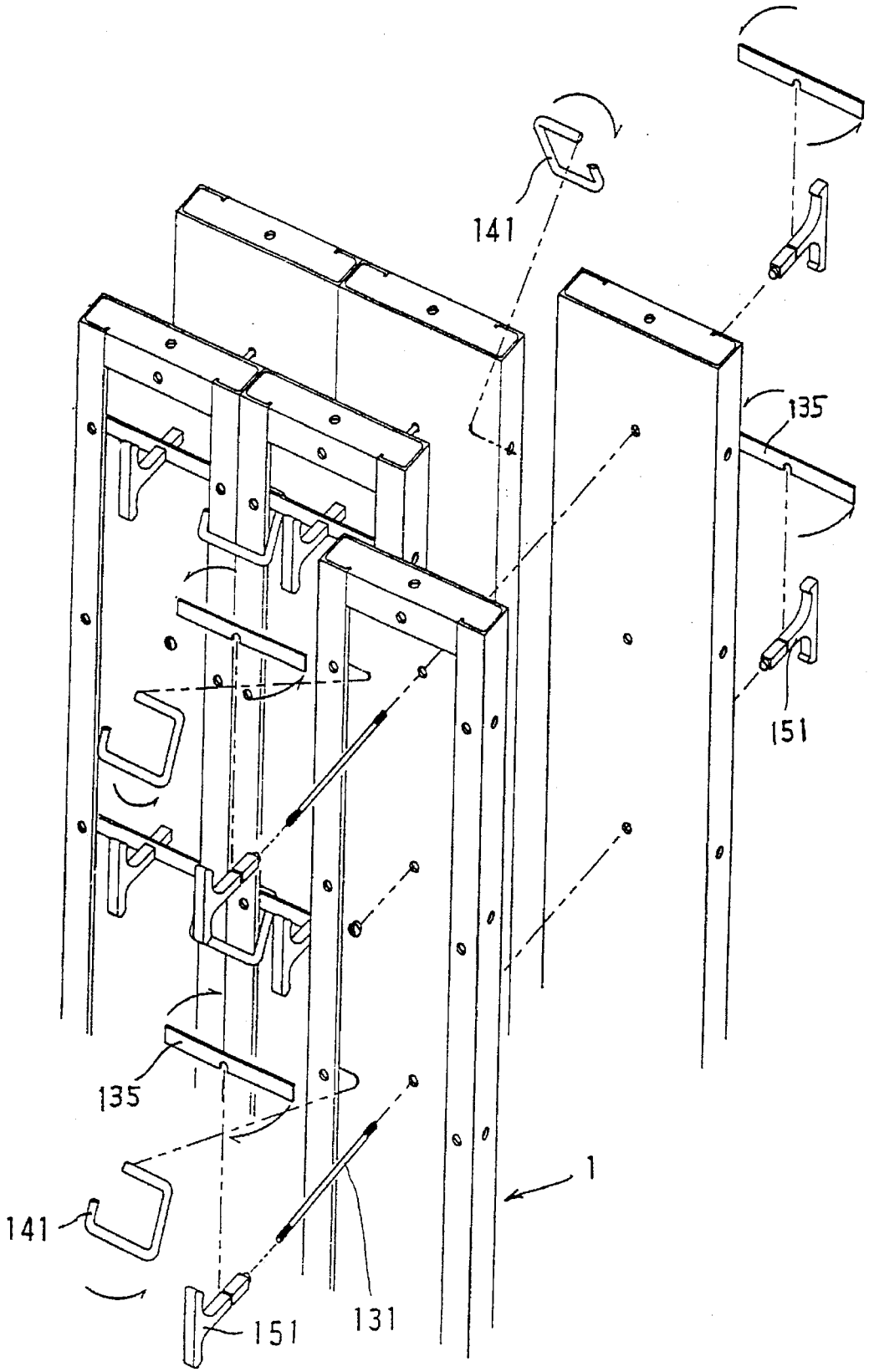
FIG. 43 is an exploded perspective view showing opposite form members which are assembled with each other through form member space holders according to another embodiment of the present invention.
Figure 44:
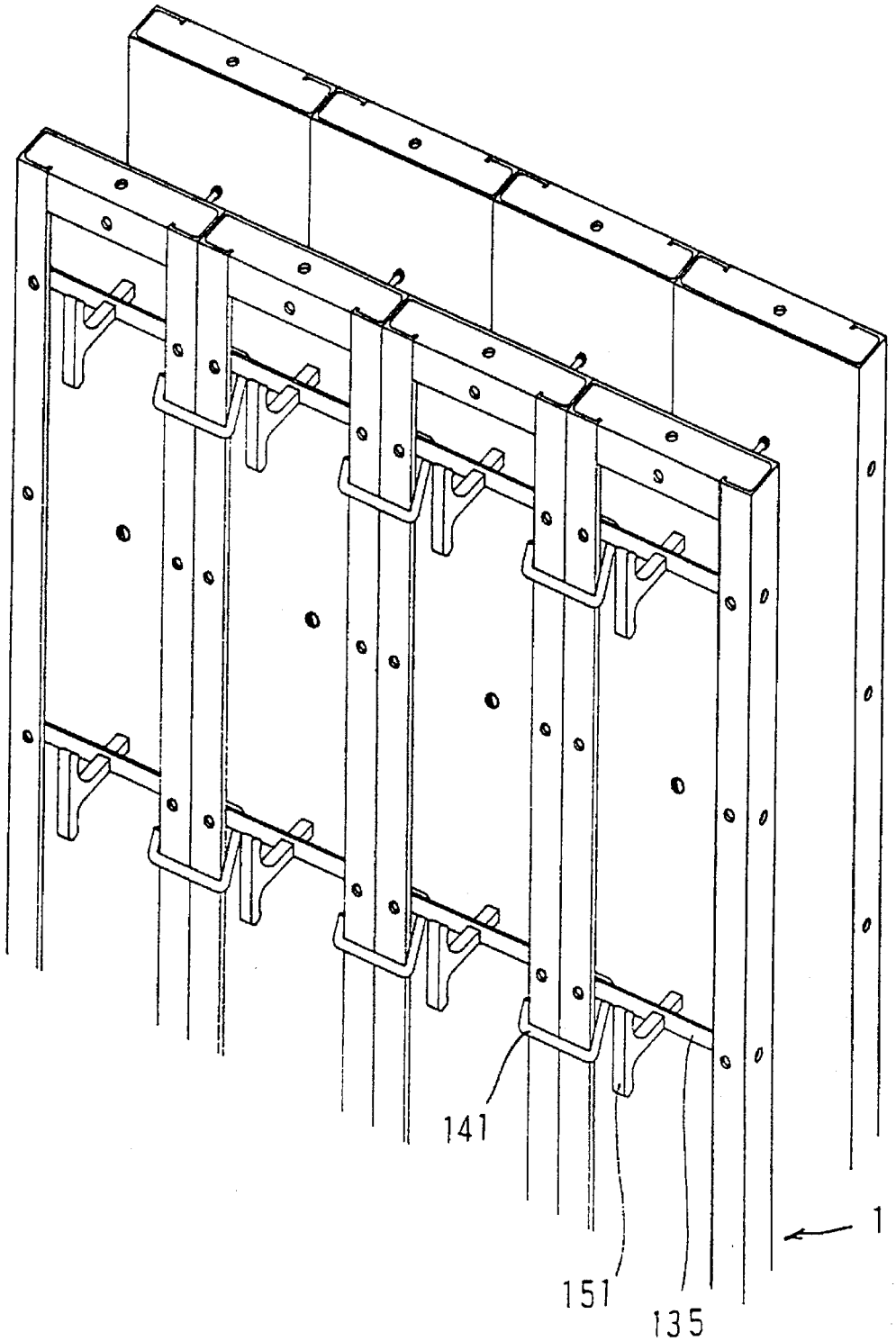
FIG. 44 is a partially fragmented perspective view showing a concrete formwork which is formed through the assembling step shown in FIG. 43.
Figure 55:
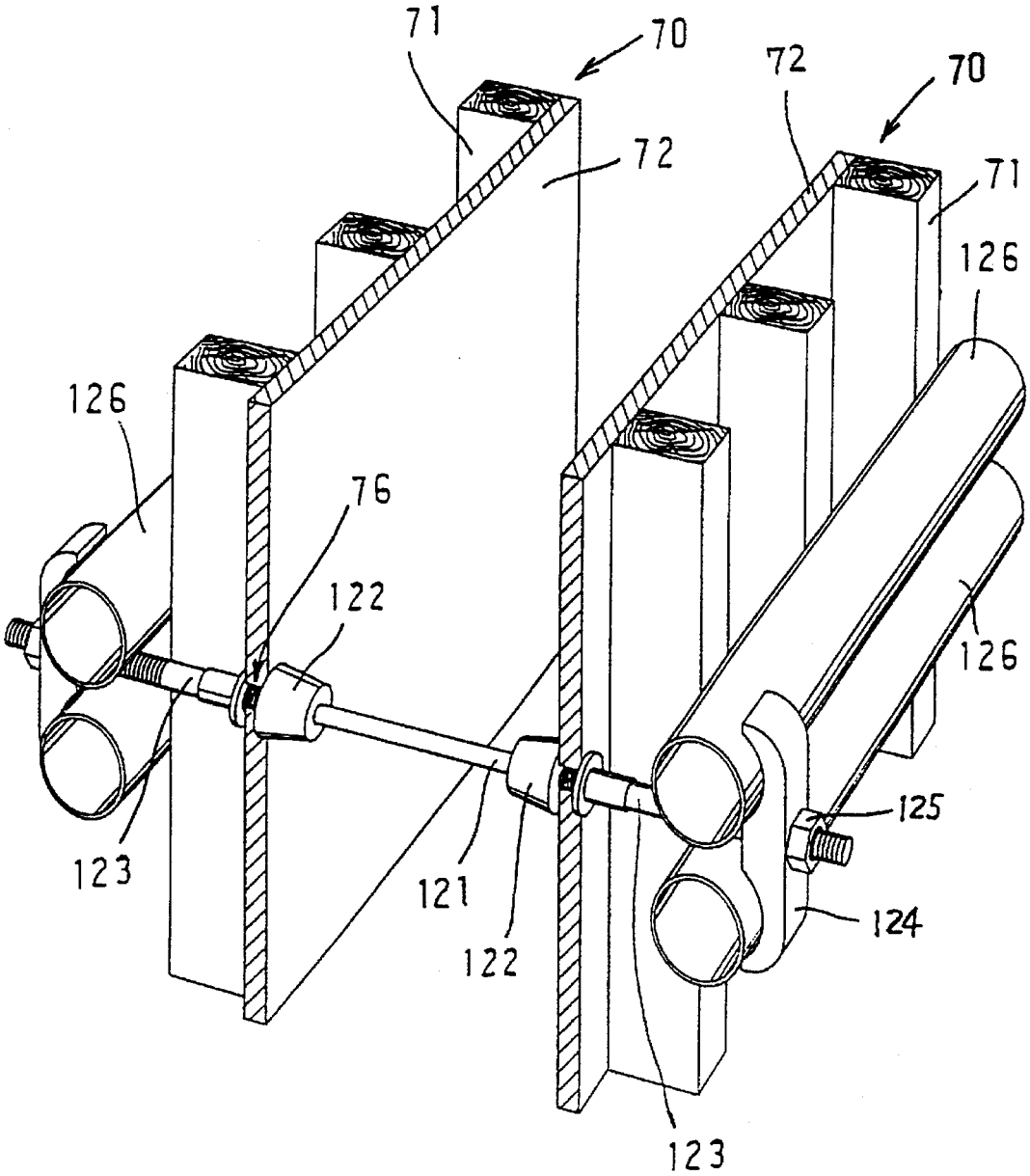
FIG. 55 PRIOR ART
FIG. 55 is a partially fragmented perspective view showing a pair of conventional wood form members which are connected with/fixed to each other by conventional form member space holders.
Figure 56A:
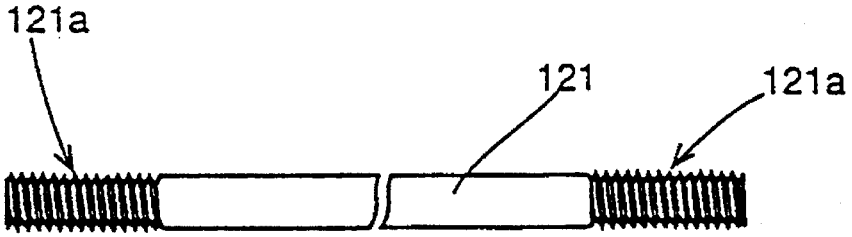
FIG. 56A PRIOR ART
FIG. 56A illustrates respective components forming a principal part of each conventional form member space holder shown in FIG. 55 with a partially fragmented separator 121.
Figure 56B:
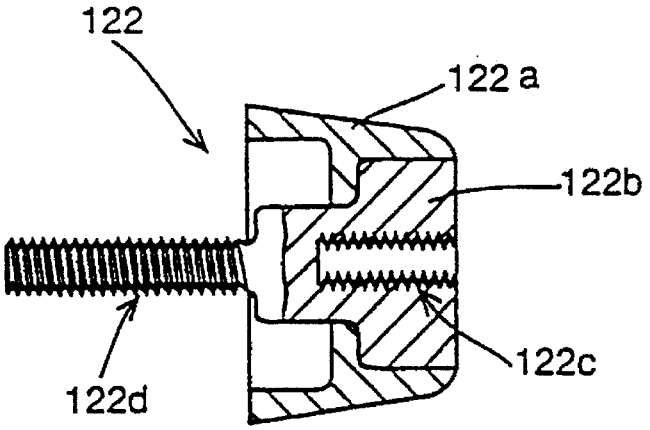
FIG. 56B PRIOR ART
FIG. 56B is a partially fragmented sectional view showing an attachment 122.
Figure 56C:
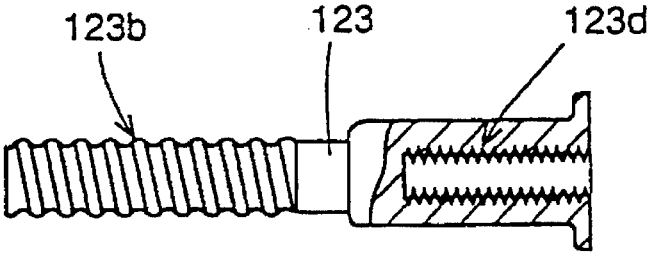
FIG. 56C PRIOR ART
FIG. 56C is a partially fragmented sectional view showing a clamp member 123.
Figure 57A:
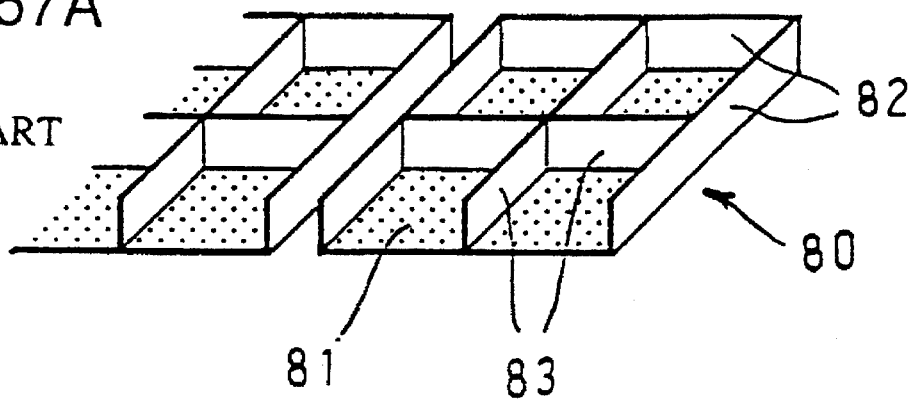
FIG. 57A PRIOR ART
FIG. 57A is a perspective view showing a typical example of a conventional metal form member.
Figure 57B:
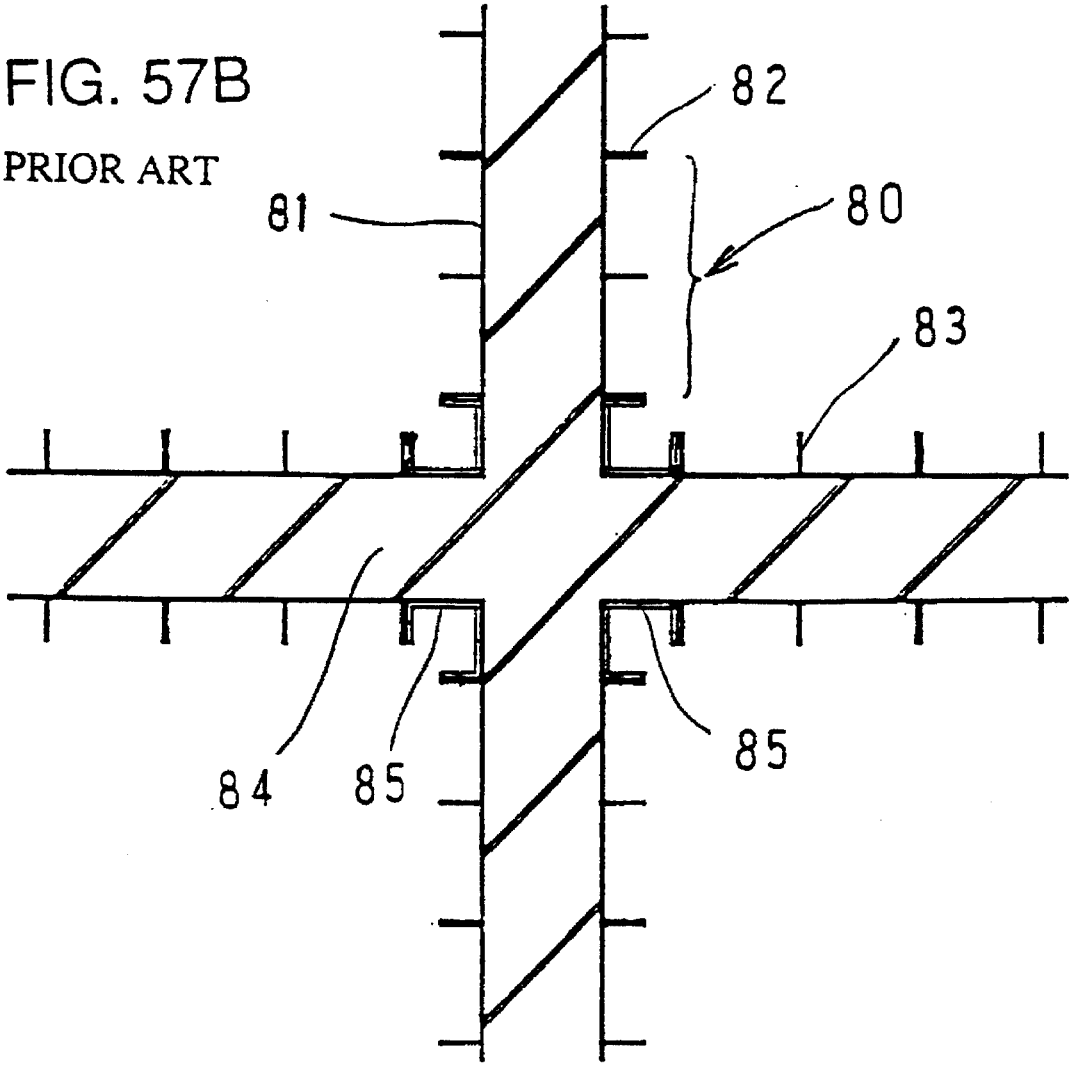
FIG. 57B PRIOR ART
FIG. 57B is a plan view showing a concrete molding formwork having a cross concrete molding portion which is formed by the metal form members shown in FIG. 57A.

FIG. 41 is a plan sectional view showing a pair of opposite form members 1 which are fixed to each other by the form member space holder according to this embodiment. The separator 131, each attachment 132 and each clamp member 133 forming the space holder according to this embodiment are coupled with each other in employment, as shown in FIG. 42A. Among these elements, the attachment 132 is shaped as shown in FIGS. 42B to 42D, so that a male screw **131*a* provided on a first end of the separator 131 is fitted with a female screw portion 132*a* which is provided on a first end thereof. On the other hand, a male screw 133*a* which is provided on a first end of the clamp member 133 is fitted with a female screw portion 132*b* provided on a second end of the attachment 132. A male screw 133*b* is provided on a second end of the clamp member 133 to be fitted with the nut 134, which is employed for fixing a bar-shaped form member support member for bridging a plurality of form members as arranged, along the direction of arrangement. As shown in FIG. 39 and 40, for example, a support member 124 is mounted on each clamp member 133, to be employed for supporting a thin cylindrical form member support member 126 which is fixed to bridge the arranged form members 1, similarly to the support member 124 of the conventional form member space holder shown in FIG. 55**.

In order to fix the opposite pair of form members 1 with the form member space holder as shown in FIG. 41, the separator 131 is inserted in the separator mounting hole 6 provided in one form member 1 while fixing relative positions of the opposite pair of form members 1, for example, so that small diameter portions of the pair of attachments 132 are fitted with the male screws 131*a* which are provided on both ends of the separator 131 while being engaged with the separator mounting holes 6 through mounting hole protective cups 63. Thereafter plate type check bars 135 are mounted on end portions, being close to the attachments 132, of the clamp members 133 which are fitted with second ends of the attachments 132 respectively. The plate-type check bars 135 have recesses for mounting on the clamp members 133 in centers of elastic rectangular flat plate members, so that portions close to both ends thereof are in contact with the pairs of rear plate portions 5 of the form members 1 and slightly elastically deformed in such mounting states for pressing the attachments 132 by elastic force thereby fixing the attachments 132 to the form members 1.

As shown in FIG. 41, the separator 131 may be inserted in a sleeve 136 before assembling the form member space holder, so that the separator 131 is removed to leave the sleeve 136 after concrete placing. In this case, the sleeve 136 is made 6f a material having low heat conductivity similarly to concrete. When such a sleeve 136 is not employed, the metal separator 131 is left in the concrete as placed. If the concrete forms a wall having temperature difference between the interior and the exterior thereof, heat conduction is caused between the interior and the exterior of the wall through the separator 131, to exert a bad influence on heat insulation of the concrete wall. When the sleeve 136 is employed so that the separator 131 is removed after concrete molding and the sleeve 136 is filled up with a member having heat conductivity similarly to the concrete, however, it is possible to avoid the aforementioned problem of deterioration in heat insulation of the concrete wall.

According to the form member space holder of this embodiment, as hereinabove described, it is possible to readily fix a pair of opposite form members to each other with relatively simple components, thereby remarkably contributing to improvement in workability for assembling a concrete molding formwork with the inventive form members.

Another embodiment of the inventive form member space holder is now described with reference to FIGS. 43 to 46. The basic structure of this embodiment is in common with that of the aforementioned embodiment described with reference to FIGS. 39 to 42, and hence the following description is made only on a point of this embodiment which is different from the aforementioned embodiment.

According to this embodiment, a T-shaped clamp member 151 consisting of a plastic molding is employed in place of the metal clamp member 133 employed in the embodiment shown in FIGS. 39 to 42. Also in this embodiment, structures similar to those shown in FIGS. 39 and 40 are applied as to a separator 131, check bars 135, a form member connecting clip and the like.

Figure 45A:
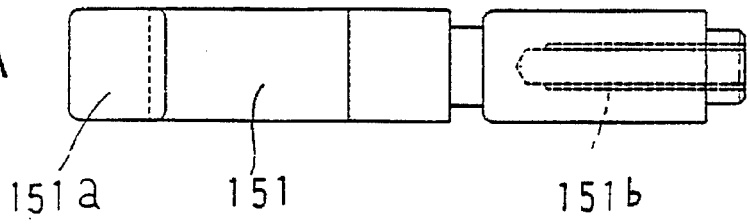
FIGS. 45A and 45B are a plan view and a front elevational view showing a clamp member 151 which is employed in the embodiment shown in FIGS. 43 and 44 respectively.
Figure 45B:
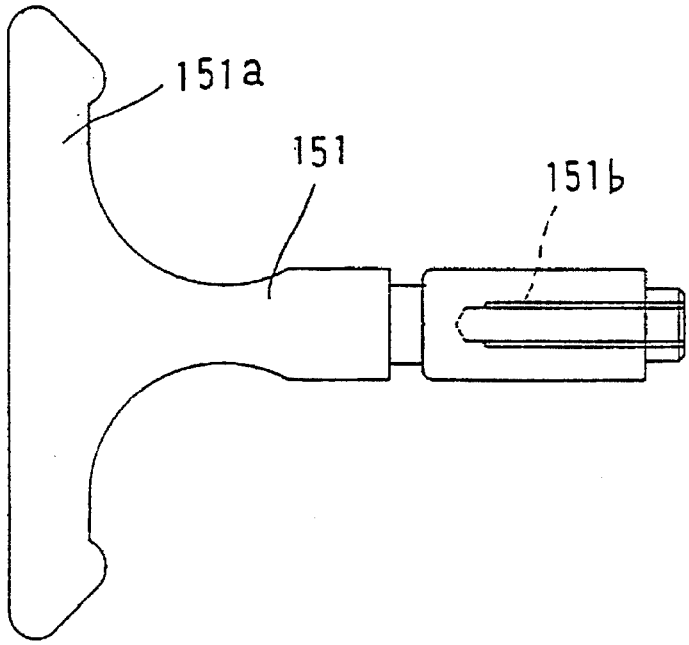
Figure 45C:
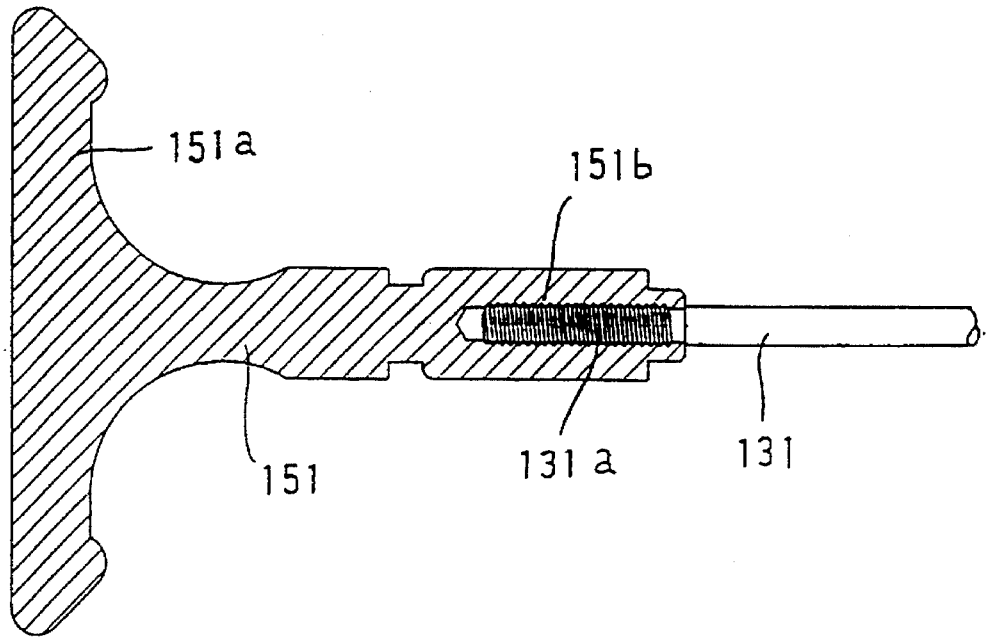
FIG. 45C is a sectional view showing a male screw 131*a* which is fitted with a female screw 151*b* of the clamp member 151.
Figure 46:
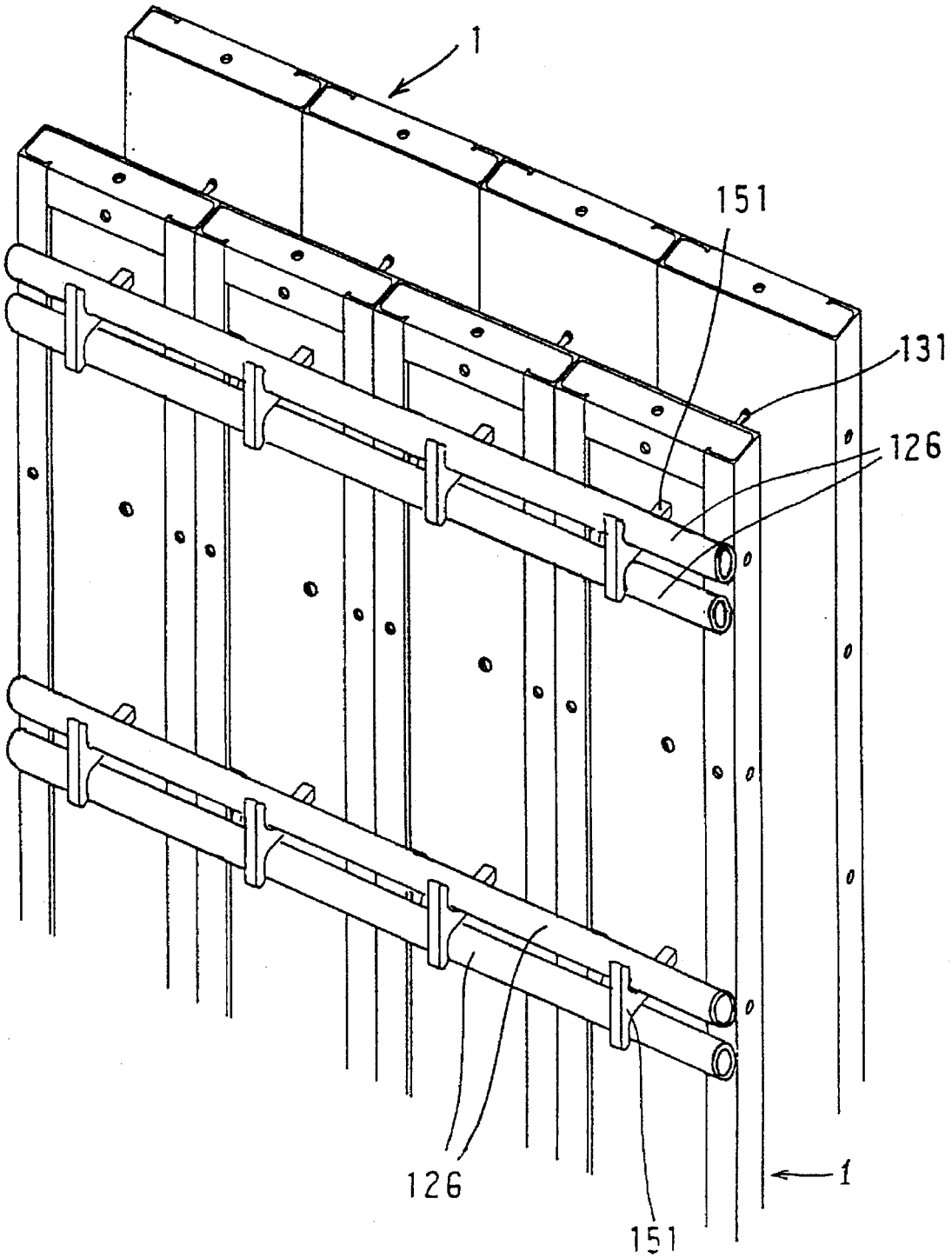
FIG. 46 is a partially fragmented perspective view showing a pair of thin cylindrical form member support members 126 which are supported by the clamp members 151 employed in the embodiment shown in FIGS. 43 to 45C.

As shown in FIGS. 45A and 45B in enlarged manners, the clamp member 151 according to this embodiment is provided with a form member support member presser portion 151*a* and a female screw 151*b* on first and second ends thereof respectively. As shown in FIG. 45C, the female screw 151*b* is fitted with a male screw 131*a* of the separator 131. As to the form member support member presser portion 151*a*, on the other hand, metal thin cylindrical form member support members 126 are pressed against form members 1 so that outer peripheries thereof are engaged along inner curved surfaces of such form member support member presser portions 151*a*, as shown in FIG. 46.

According to the form member space holder of this embodiment, it is possible to hold a space between opposite form members at a prescribed distance by a simple operation of fitting the male screw 131*a* provided on the end of each separator 131 with the female screw 151*b* of each T-shaped clamp member 151, with no requirement for members corresponding to the attachments 132 and the nuts 134 employed in the aforementioned embodiment shown in FIGS. 39 to 42. At the same time, a vertical pair of thin cylindrical form member support members 126 are supported by the form member support member presser portion 151*a* of the clamp member 151, whereby the clamp member 151 can serve both as the clamp member 133 and the support member 124 provided in the aforementioned embodiment. Further, a plastic molding can be applied as the clamp member 151 according to this embodiment, whereby the production cost can be extremely reduced.

Figure 47:
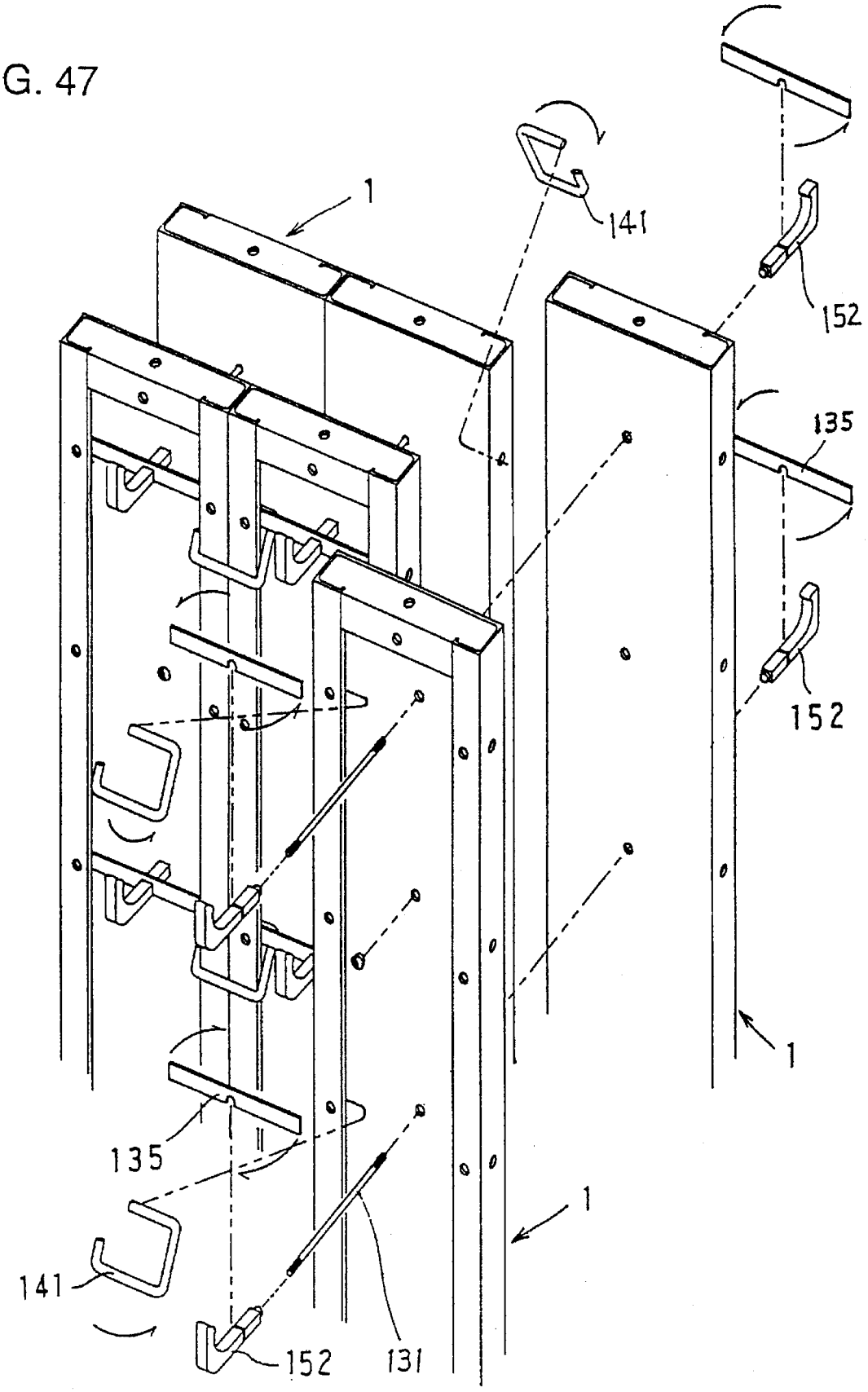
FIG. 47 is an exploded perspective view showing opposite form members which are assembled with each other by form member space holders according to still another embodiment of the present invention.
Figure 48A:
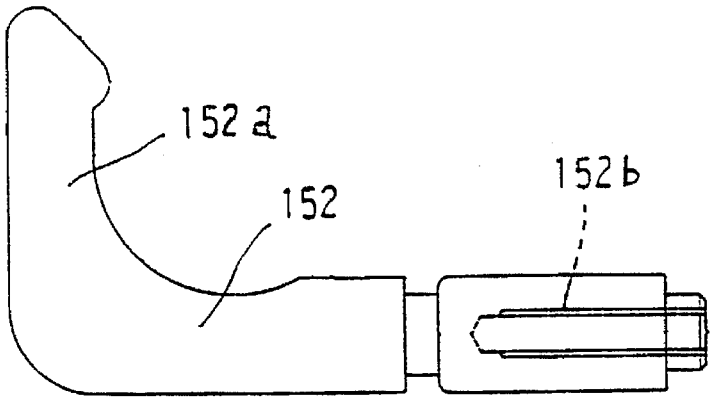
FIG. 48A is a front elevational view of a clamp member 152 which is employed in the embodiment shown in FIG. 47.

Still another embodiment of the form member space holder according to the present invention is now described with reference to FIGS. 47 to 49. The form member space holder according to this embodiment is different from the aforementioned embodiment shown in FIGS. 43 to 46 in a point that an L-shaped clamp member 152 is employed in place of the T-shaped clamp member 151 of the aforementioned embodiment. As shown in FIG. 47, a separator 131, check bars 135, a form member connecting clip and the like are similar to those of the embodiment shown in FIG. 44. FIG. 48A is a front elevational view of the clamp member 152 according to this embodiment. A plan view of the clamp member 152 is identical to FIG. 45A for the aforementioned embodiment.

Figure 48B:
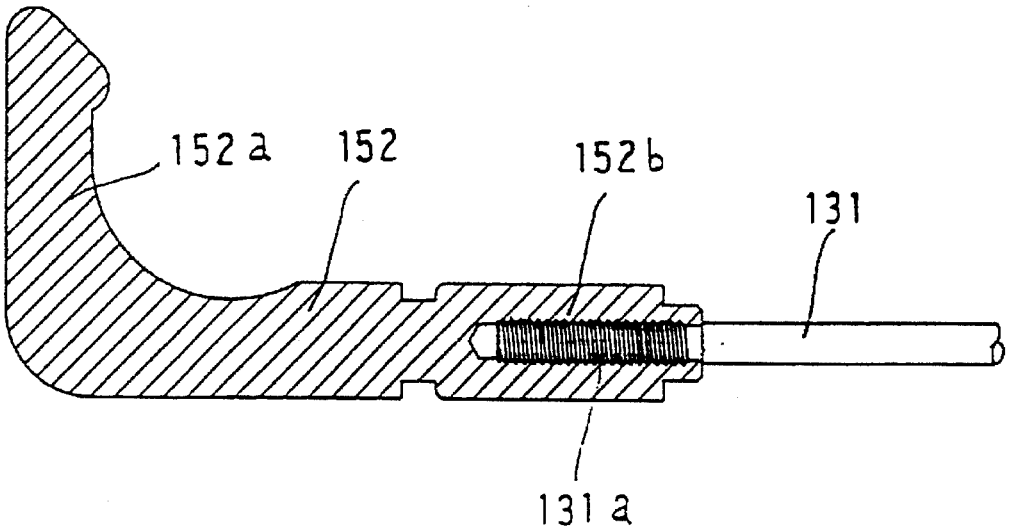
FIG. 48B is a sectional view showing a male screw 131*a* of a separator 131 which is fitted with a female screw 152*b* of the clamp member 152.
Figure 49:
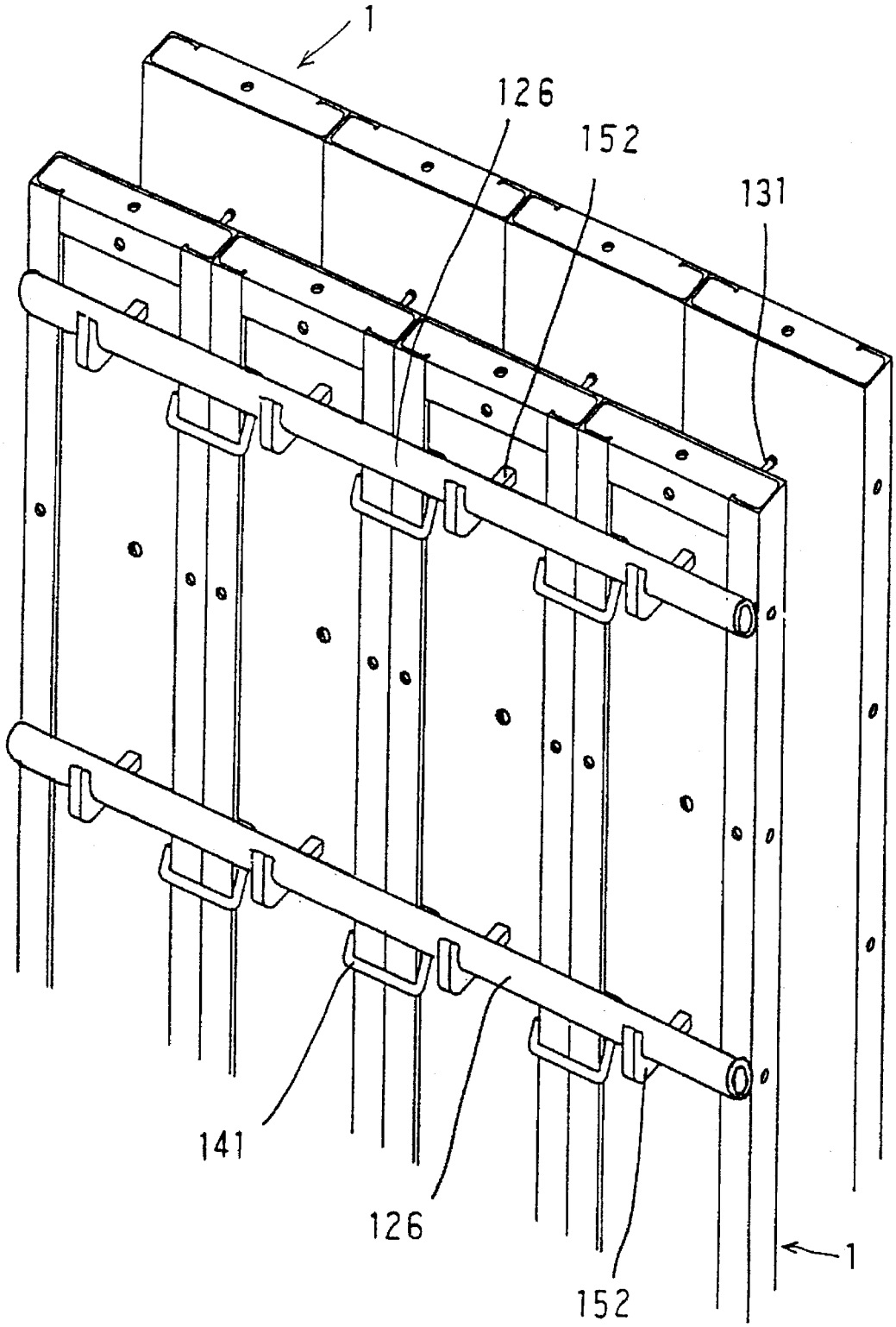
FIG. 49 is a partially fragmented perspective view showing thin cylindrical form member support members 126 which are supported by the clamp members 152 employed in the embodiment shown in FIGS. 47 and 48.

Also in the form member space holder according to this embodiment, it is possible to hold a space between opposite form members at a prescribed distance while supporting thin cylindrical form member support members 126 as shown in FIG. 49, by a simple operation of fitting a male screw 131*a* of each separator 131 with a female screw 152*b* of each clamp member 152 as shown in FIG. 48B. The clamp member 152 according to this embodiment can also be formed by a plastic molding, thereby reducing the production cost in addition to improvement in working efficiency.

While the inventive concrete molding form member is only applied to a concrete formwork for forming a wall-shaped portion vertically extending along a building in each of the aforementioned embodiments, the form member according to the present invention is also effectively applicable to execution of a concrete formwork for forming the so-called slab, which is a concrete member for forming the floor of a building, as described below.

Figure 50:
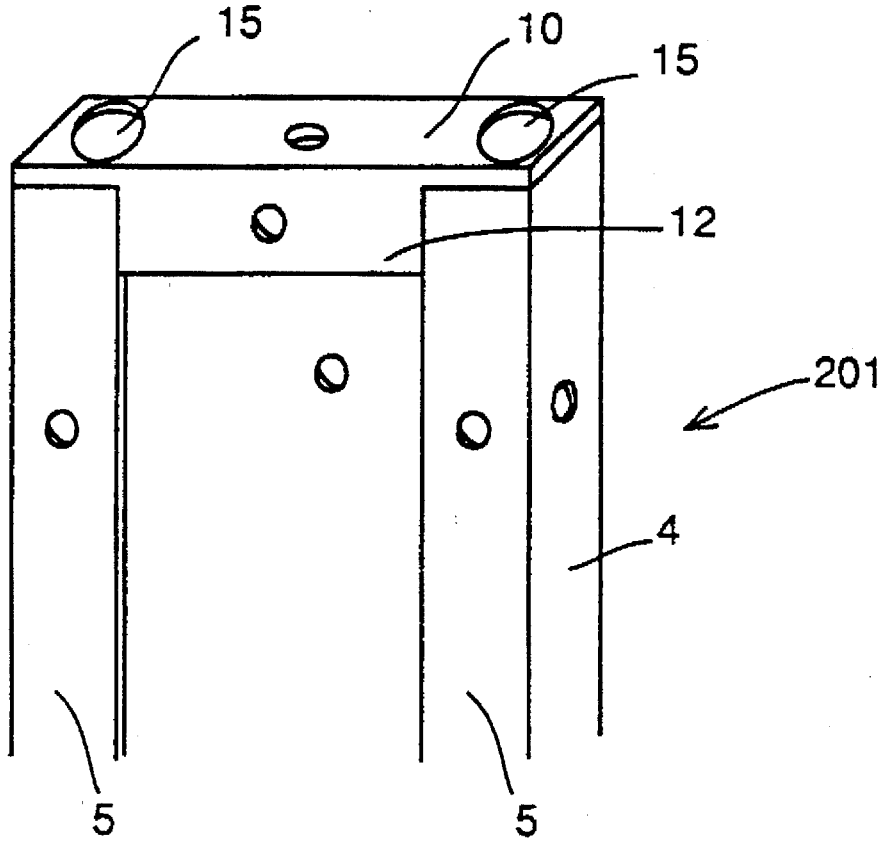
FIG. 50 is a partially fragmented perspective view showing a concrete molding form member according to a further embodiment of the present invention.
Figure 51:
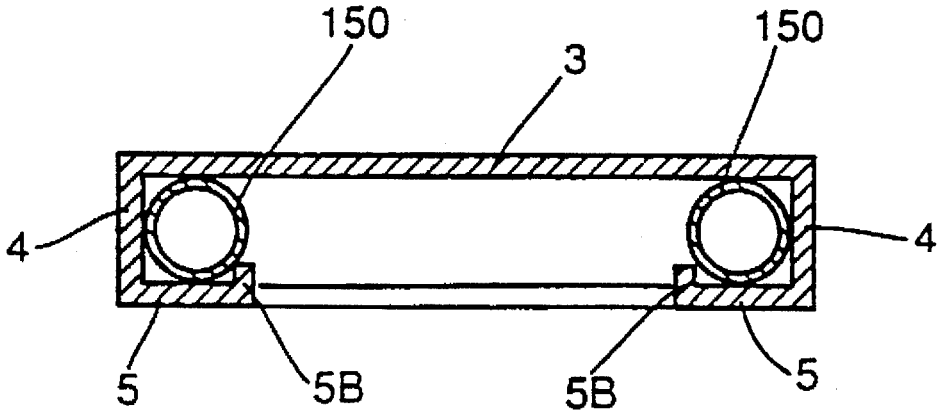
FIG. 51 is a cross-sectional view taken along the line X—X in FIG. 52B showing a concrete molding form member 201 appearing in FIG. 50 which is connected by pipe-shaped long bars 150.

In a form member according to the present invention which is applied to assembling of a concrete formwork for forming a slab, a pair of through holes 15 having the same inner diameters are provided in the vicinity of horizontal side ends of an end plate body 10 of a form member 201, as shown in FIG. 50, for example. Due to the pair of through holes 15, it is possible to longitudinally connect two form members 201 with each other by longitudinally serially arranging the form members 201 so that the through holes 15 thereof are opposed to each other and inserting pipe-shaped long bars 150, which are sized to be engaged with the through holes 15, in the opposite through holes 15. FIG. 51 is an enlarged sectional view taken along the line X—X in FIG. 52B. When pairs of through holes 15 are formed in the end plate bodies 10 provided on upper and lower ends of each form member 201 respectively, it is also possible to longitudinally connect three or more form members with each other in a similar manner to the above.

Figure 52A:
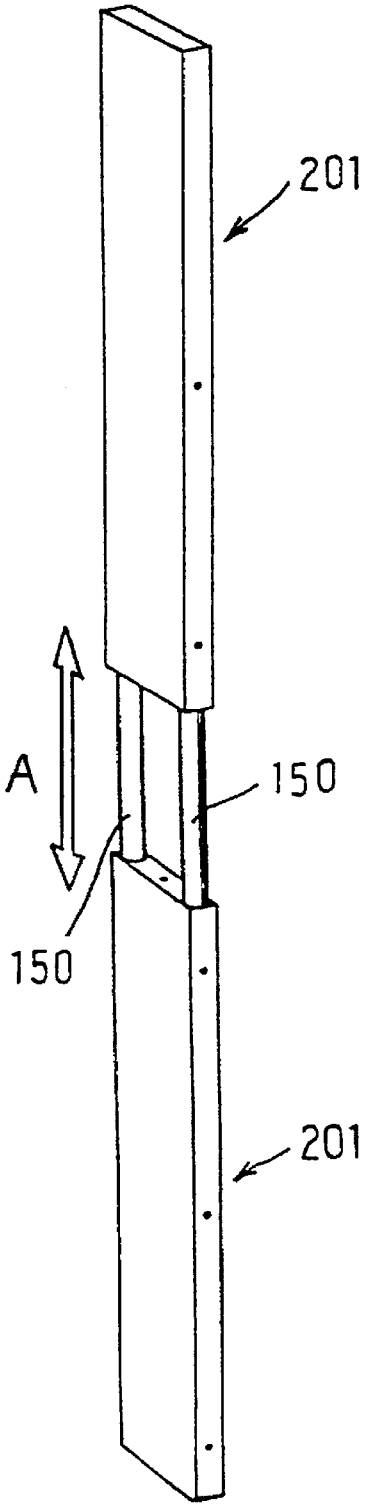
FIG. 52A is a perspective view showing two concrete molding form members 201 appearing in FIG. 50 which are connected with each other by the pipe-shaped long bars 150.
Figure 52B:
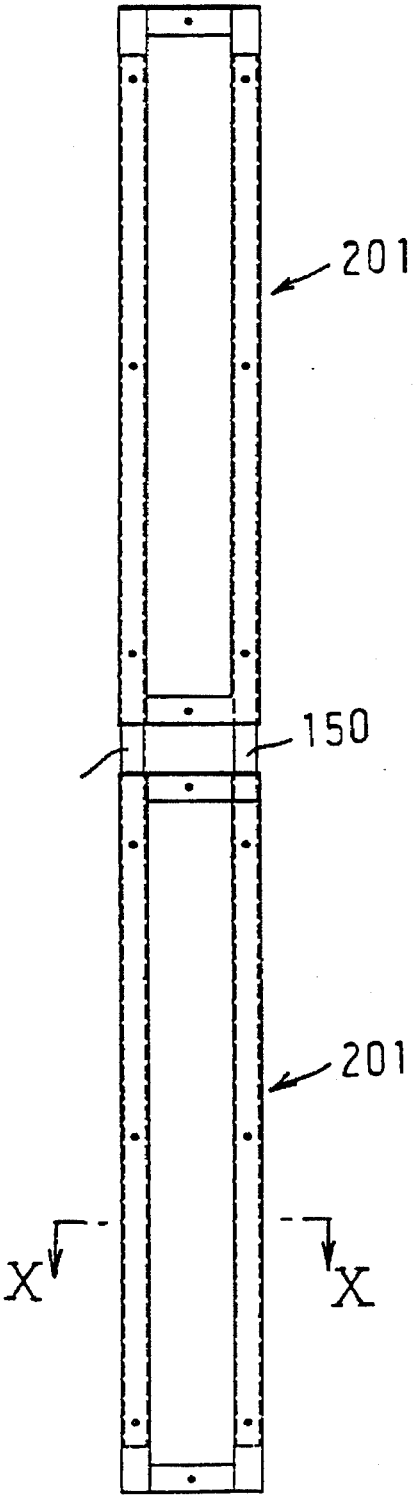
FIG. 52B illustrates connected form members, which are similar to those shown in FIG. 52A, as viewed from behind.

The form members 201 which are longitudinally connected with each other can be arbitrarily contracted along arrow A shown in FIG. 52A, due to sliding movement between the connecting pipe-shaped long bars 150 and the respective form members 201. The pipe-shaped long bars 150 are stored in respective spaces which are enclosed with front plate portions 3, pairs of side plate portions 4, pairs of rear plate portions 5 and pairs of reinforcing thick portions 5B of the form members 201 and engaged to be substantially in contact with the inner peripheral surfaces of the spaces, whereby no transverse misalignment is caused between the form members 201 and the pipe-shaped long bars 150. Further, the pipe-shaped log bars 150 themselves serve as reinforcing members, whereby the form members 201 as connected can attain sufficient strength against transverse loads.

Figure 53:
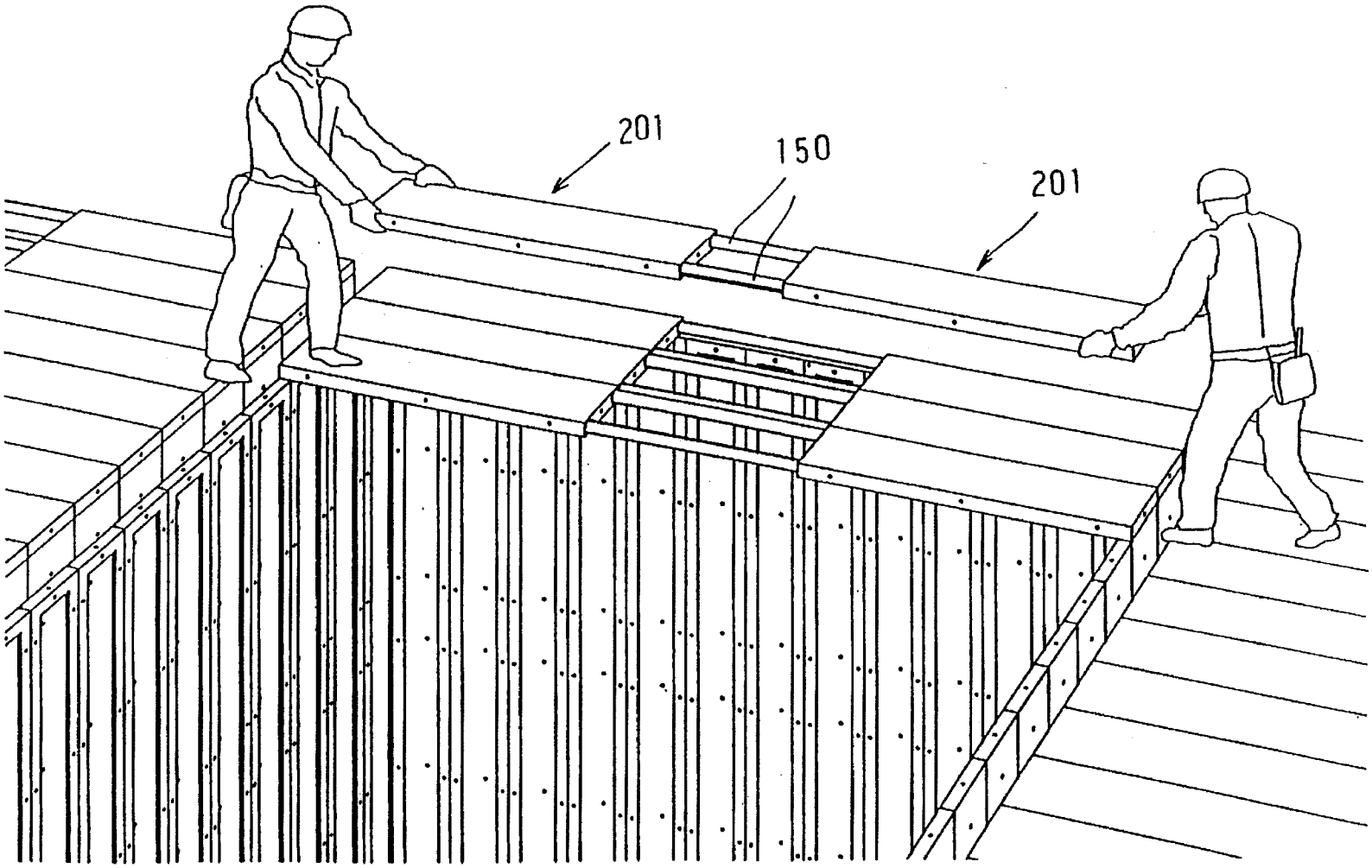
FIG. 53 is a perspective view showing workmen assembling a concrete formwork for forming a slab with the connected form members shown in FIG. 52A.
Figure 54A:
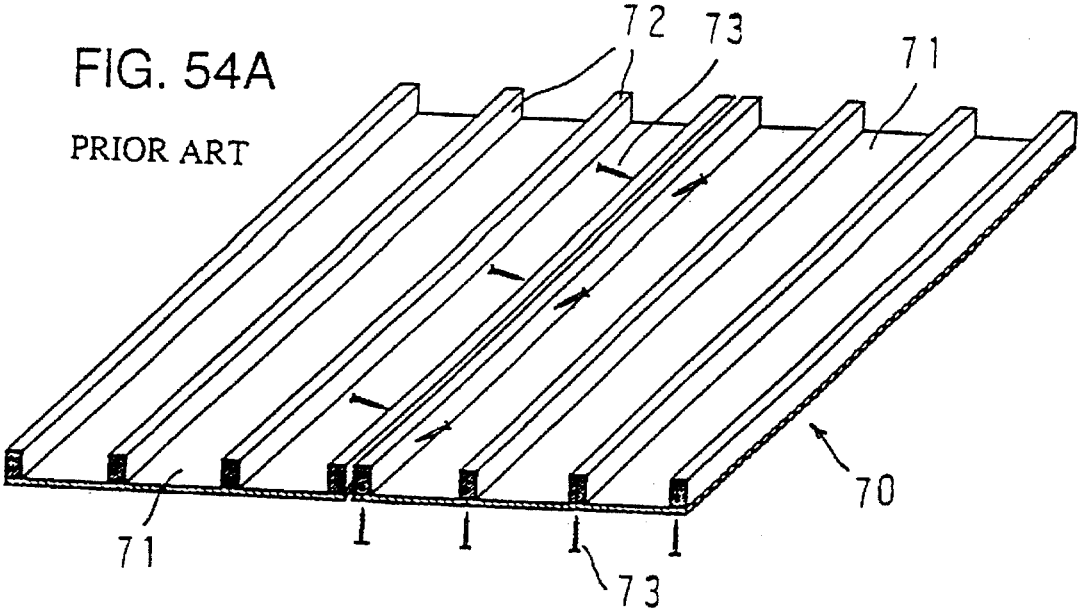
FIG. 54A PRIOR ART
FIG. 54A is a perspective view showing a typical example of a conventional wood form member.
Figure 54B:
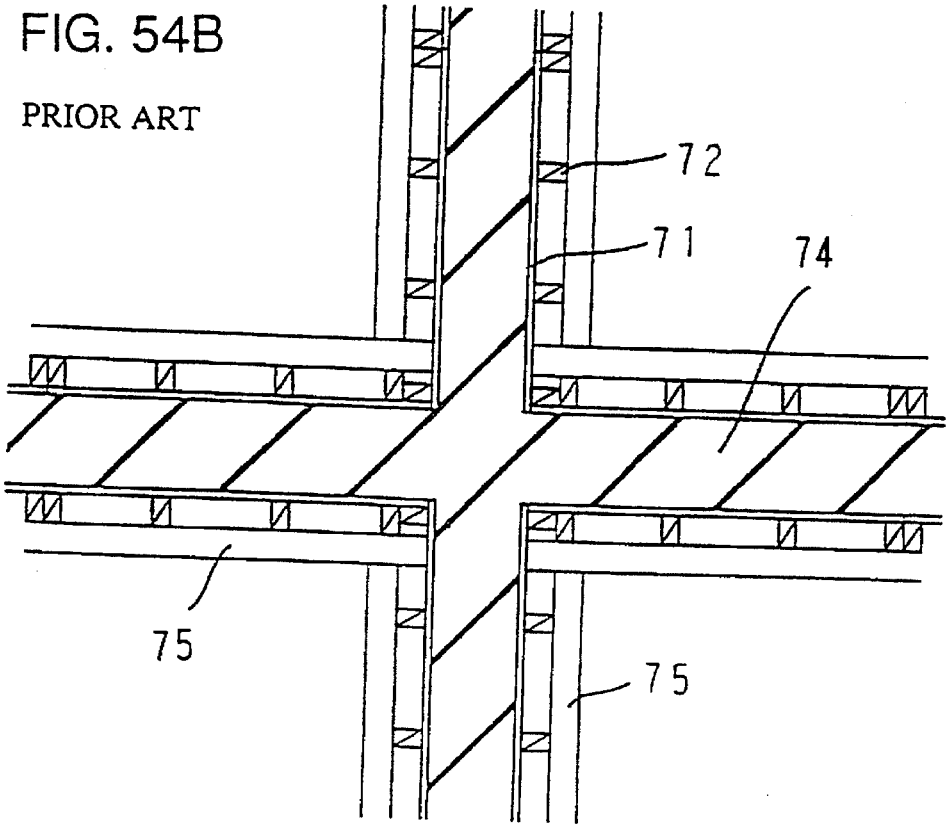
FIG. 54B PRIOR ART
FIG. 54B is a plan view showing a concrete formwork having a cross concrete molding portion which is formed by the form members shown in FIG. 54A.

FIG. 53 shows a state of building a concrete formwork for forming a slab with the form members 201 which are longitudinally connected with each other. Referring to FIG. 53, horizontally arranged form members 201 which are now being assembled with each other are adapted to form a bottom surface of the concrete formwork for forming a slab. Plywood boards or the like are engaged in the portions exposing pipe-shaped long bars 150 for connecting the form members 201 with each other, so that overall form member surfaces for forming the floor of the slab are laid with no clearances.

The existent metal form member requires large-sized support means due to its heavy weight, while it is difficult to build a concrete formwork for forming a slab with existent plastic form members, due to a high cost. In general, therefore, a concrete formwork for forming a slab is inevitably formed by plywood form members. Under such circumstances, the form members according to the embodiment of the present invention shown in FIGS. 50 to 52 remarkably improve applicability to a slab due to the specific advantages such as lightweightness, high strength and retractability. The advantages of the form member according to this embodiment are applicable not only to a concrete formwork for forming a slab but to a concrete formwork for forming a wall, as a matter of course.

The concrete molding form member, the form member connector and the form member space holder according to the present invention are not restricted to the modes shown in the aforementioned embodiments but can be appropriately modified within the range of the technical idea of the present invention, as a matter of course.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A concrete molding form member comprising:

a strip front plate portion being flat at least on its surface;

a horizontal pair of strip side plate portions extending from both side ends of said front plate portion toward a back surface thereof perpendicularly to said front plate portion; and a horizontal pair of strip rear plate portions inwardly extending from rear ends of said side plate portions perpendicularly to said side plate portions, to be opposed to said back surface of said front plate portion, each of said front plate portion, said side plate portions and said rear plate portions being provided with a plurality of mounting holes on the same positions in relation to the longitudinal direction at prescribed intervals along the longitudinal direction, wherein the distance ($L_1$) between the center of each mounting hole in said side plate portions and an edge of said front plate portion is substantially equal to the distance ($L_2$) between the center of each mounting hole in said rear plate portions and the intersection of said side plate portions with said rear plate portions, and the width of each side plate portion is substantially equal to the width of each rear plate portion.

2. The concrete molding form member in accordance with claim 1, wherein said front plate portion, said pair of side plate portions and said pair of rear plate portions define a form member body, said concrete molding form member further comprising an end plate body being provided with:

a horizontal end plate portion being arranged on at least one of upper and lower ends of said form member body for shielding an upper or lower end of a space having a rectangular horizontal section being enclosed with said front plate portion, said pair of side plate portions and said pair of rear plate portions, and a vertical end plate portion extending from a rear end of said horizontal end plate portion perpendicularly to said horizontal end plate portion, to be in contact with inner surfaces of said pair of rear plate portions, said horizontal and vertical end plate portions being provided on horizontal centers thereof with mounting holes respectively, wherein the distance ($L_3$) between the center of each mounting hole in said horizontal end plate portion and an edge of said front plate portion is substantially equal to the distance ($L_4$) between the center of each mounting hole in said vertical end plate portion and the intersection of said horizontal end plate portion and said vertical end front plate portion and substantially equal to $L_1$.

3. The concrete molding form member in accordance with claim 1, wherein said front plate portion, said pair of side plate portions and said pair of rear plate portions consist of an integrally formed fiber reinforced plastic member.

4. The concrete molding form member in accordance with claim 2, wherein said form member body and said end plate body consist of integrally formed fiber reinforced plastic members respectively.

5. The concrete molding form member in accordance with claim 2, wherein a pair of through holes for longitudinally serially connecting said form members, said through holes having the same inner diameters, are provided in proximity to the intersections of side plate portions and said horizontal end plate portions.

6. The concrete molding form member in accordance with claim 5, wherein said pair of rear plate portions of said form member body are provided on inner side end portions thereof with reinforcing thick portions extending from said inner side end portions partially toward said front plate portion perpendicularly to said pair of rear plate portions, thereby forming a pair of horizontal spaces having square horizontal sections, each enclosed by said front plate portion, said side plate portion, said rear plate portion, and a plane formed by extending said reinforcing thick portion to said front plate portion, each of said pair of through holes being provided in said horizontal end plate portion of said end plate body being arranged in a horizontal space.

* * * * *